US009189921B2

(12) United States Patent
Spencer et al.

(10) Patent No.: US 9,189,921 B2
(45) Date of Patent: Nov. 17, 2015

(54) PROGRESSIVE VALUE TRACKING AND PUBLICATION IN GAMING SYSTEMS

(71) Applicant: IGT, Reno, NV (US)

(72) Inventors: David J. Spencer, Kilarney Heights (AU); Kevin Higgins, Reno, NV (US); Chad Little, Reno, NV (US)

(73) Assignee: IGT, Reno, NV (US)

( * ) Notice: Subject to any disclaimer, the term of this patent is extended or adjusted under 35 U.S.C. 154(b) by 102 days.

(21) Appl. No.: 13/796,396

(22) Filed: Mar. 12, 2013

(65) Prior Publication Data

US 2014/0274349 A1 Sep. 18, 2014

(51) Int. Cl.
*G07F 17/32* (2006.01)

(52) U.S. Cl.
CPC ..... *G07F 17/3258* (2013.01)

(58) Field of Classification Search
CPC ..... G07F 17/3258
USPC ..... 463/16–20, 27, 40
See application file for complete search history.

(56) References Cited

U.S. PATENT DOCUMENTS

| | | | | |
|---|---|---|---|---|
| 8,216,056 | B2 * | 7/2012 | Lutnick et al. | 463/22 |
| 8,579,704 | B2 * | 11/2013 | Torres | 463/27 |
| 8,684,831 | B2 * | 4/2014 | Guan et al. | 463/27 |
| 2005/0239542 | A1 * | 10/2005 | Olsen | 463/27 |
| 2007/0060263 | A1 * | 3/2007 | Englman et al. | 463/16 |
| 2007/0060365 | A1 * | 3/2007 | Tien et al. | 463/42 |
| 2008/0254893 | A1 * | 10/2008 | Patel et al. | 463/42 |
| 2009/0131160 | A1 * | 5/2009 | Torres | 463/27 |
| 2011/0014964 | A1 * | 1/2011 | Crowder et al. | 463/13 |
| 2012/0004028 | A1 * | 1/2012 | Guan et al. | 463/27 |
| 2012/0108324 | A1 * | 5/2012 | King | 463/27 |
| 2012/0122558 | A1 * | 5/2012 | Lyons et al. | 463/25 |
| 2013/0053135 | A1 * | 2/2013 | King | 463/27 |

* cited by examiner

*Primary Examiner* — Michael Cuff
(74) *Attorney, Agent, or Firm* — Griffiths & Seaton PLLC

(57) ABSTRACT

A gaming system harvests a current progressive value from available gaming devices. A protocol is implemented that incorporates the current progressive value with current geolocation data associated with the available plurality of gaming devices as a universal progressive data feed. The universal progressive data feed is published.

40 Claims, 12 Drawing Sheets

Linked Progressive with Progressive Controller

Standalone Progressive

PROGRESSIVE VALUE TRACKING AND PUBLICATION IN GAMING SYSTEMS

COPYRIGHT NOTICE

A portion of the disclosure of this patent document contains or may contain material, which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

1. Field of the Invention

The present invention relates in general to gaming devices and systems, and more particularly to techniques for tracking and publishing a current progressive value.

2. Description of the Related Art

Games of chance have been enjoyed by people for many years and have undergone increased and widespread popularity in recent times. As with most forms of entertainment, some players enjoy playing a single favorite game, while others prefer playing a wide variety of games. In response to the diverse range of player preferences, gaming establishments commonly offer many types of games and, in some cases, the potential for increased awards associated with certain games.

Individuals and group players often times seek for popular gaming devices (e.g., electronic gaming machine such as slot machines, video poker, and the like) that have large and frequent jackpots and awards, which are paid out at an increased rate compared to other gaming systems. Typically, awareness of the gaming devices with large and/or frequent awards are based on word of mouth, notifications on the gaming device itself, and/or a users historical experience. Moreover, players prefer to maintain their social interactivity while participating in gaming environments and share their gaming success.

SUMMARY OF THE DESCRIBED EMBODIMENTS

A current challenge for gaming institutions, in view of increasingly popular use by players, and an increasing number of gaming machines, tables and the like in gaming environments, is the providing of updated information to the player relating to characteristics of certain gaming systems and devices, such as, for example, whether a particular gaming device (e.g., electronic gaming machine "EGM") is successful in returning awards, or "hot," which may encourage further use by players in the environment. For example, a player may search a particular gaming establishment, expending time and other resources in the search for a particular machine thought to be successful instead of enjoying the gaming experience and/or sharing the experience with friends.

In view of the foregoing, a need exists for a mechanism whereby characteristics of the gaming environment are provided to players in real time, such as which gaming devices in a geographic location of a particular venue are providing the biggest progressive awards and similar characteristic information, so that the player is better informed and his gaming experience is enriched. In addition, a need exists for such a mechanism to facilitate the player to be able to socially communicate such characteristic information to friends and other associates.

To address these aforementioned needs, in one embodiment, by way of example only, a method is provided for processing data in a gaming system having at least one processor. A current progressive value is harvested from available gaming devices. A protocol is implemented that incorporates the current progressive value with current geolocation data associated with the available plurality of gaming devices as a universal progressive data feed. The universal progressive data feed is published to be accessible, for example, to an external application. In addition to the foregoing exemplary method embodiment, other exemplary system and computer product embodiments are provided and supply related advantages.

The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
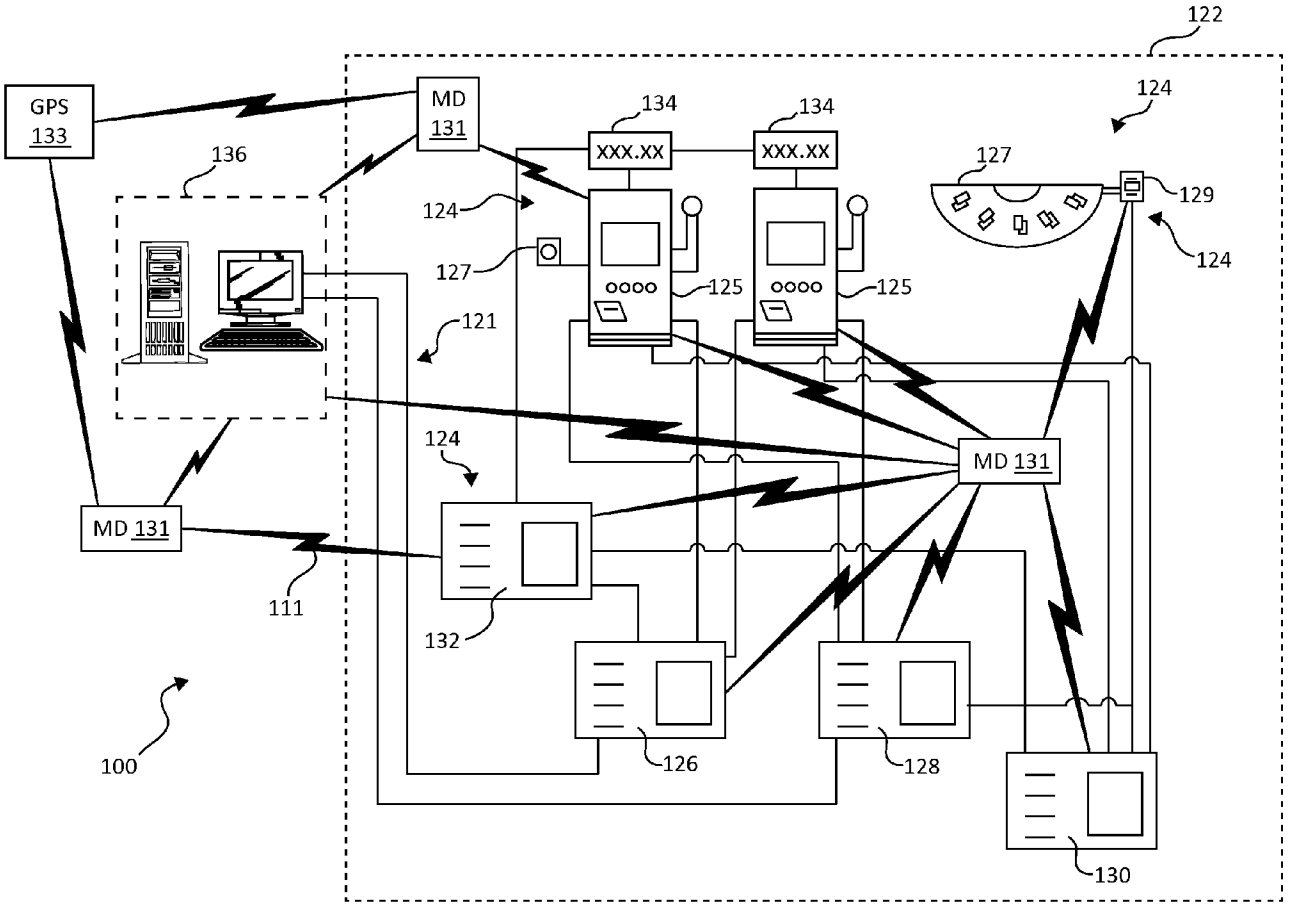
FIG. 1 is a block diagram illustrating a gaming system environment with a gaming terminal data repository (GTDR) connected via one or more network interface(s) to a gaming network which, for example, may include gaming devices (e.g., gaming terminals), in which aspects of the present invention may be realized.

In general, gaming machines require a player to place or make a wager to activate a primary or base game. The award may be based on the player obtaining a winning symbol or symbol combination and on the amount of the wager (e.g., the higher the wager, the higher the award). Symbols or symbol combinations that are less likely to occur usually provide higher awards. In such gaming machines, the amount of the wager made on the base game by the player may vary. For instance, a gaming machine may allow the player to wager a minimum number of credits, such as one credit (e.g., one penny, nickel, dime, quarter or dollar) up to a maximum number of credits, such as five credits. The player may make this wager a single time or multiple times in a single play of a primary game. For instance, a slot game may have one or more pay lines and the slot game may allow the player to make a wager on each pay line in a single play of the primary game. Slot games with 1, 3, 5, 9, 15 and 25 lines may be provided. Thus, a gaming device, such as a slot game, may allow players to make wagers of substantially different amounts on each play of the primary or base game ranging, for example, from one credit up to 125 credits (e.g., five credits on each of 25 separate pay lines). This is also true for other wagering games, such as video draw poker, where players can wager one or more credits on each hand and where multiple hands can be played simultaneously. Different players play at substantially different wagering amounts or levels and at substantially different rates of play.

Secondary or bonus games may also be provided in the gaming machines. The secondary or bonus games may provide an additional award to the player. Secondary or bonus games may not require an additional wager by the player to be activated. Secondary or bonus games may be activated or triggered upon an occurrence of a designated triggering symbol or triggering symbol combination in the primary or base game. For instance, a bonus symbol occurring on the pay line on the third reel of a three-reel slot machine may trigger the secondary bonus game. When a secondary or bonus game is triggered, the gaming machines may indicate this to the player through one or more visual and/or audio output devices, such as the reels, lights, display units, speakers, video screens, etc. Part of the enjoyment and excitement of playing certain gaming machines is the occurrence of the secondary or bonus game (even before the player knows how much the bonus award will be). In other words, obtaining a bonus award is part of the enjoyment and excitement for players.

Progressive awards may also be provided in gaming machines. A progressive award may be an award amount that includes an initial amount funded by a casino and an additional amount funded through a portion of each wager made on the progressive gaming machine. For example, 1% to 5% of each wager placed on the primary game of the gaming machine associated with the progressive award may be allocated to the progressive award or progressive award fund. The progressive award grows in value as more players play the gaming machine, and thus, portions of these players' wagers are allocated to the progressive award. When a player obtains a winning symbol or symbol combination, which results in the progressive award, the accumulated progressive award is provided to the player. After the progressive award is provided to the player, the amount of the next progressive award may be reset to an initial value, a predetermined value, or randomly generated value, and a portion of each subsequent wager on a gaming machine associated with the progressive is allocated to the next progressive award as described above.

A progressive award may be associated with a single gaming machine or multiple gaming machines which each contribute portions of the progressive award. The multiple gaming machines may be in the same bank of machines, in the same casino or gaming establishment (usually through a local area network ("LAN")) or in two or more different casinos or gaming establishments (usually through a wide area network ("WAN")). Such progressive awards are sometimes called local area progressive ("LAP") and wide area progressive ("WAP"), respectively. Progressive awards may increment through communication between a progressive controller and one or more gaming machines. The gaming machines associated with the progressive award transfer coin-in information to a progressive controller. From this information, the progressive controller calculates how much to increment the progressive award based on a set increment rate and then increments the progressive award accordingly. The gaming machines may provide the player a choice between different wager levels prior to the commencement of a primary game. The different wager levels enable the player to win different progressive awards. The gaming devices provide a progressive jackpot where the value of the jackpot may increase by a particular amount for every game played. Thus, when multiple gaming devices are linked together to form one large progressive jackpot, the jackpot grows more quickly because multiple players are contributing to the jackpot at the same time.

As mentioned above, users of gaming devices have a general interest in, and may expend resources trying to identify, which of the gaming devices are paying out the largest and most frequent awards and/or progressive jackpots. Given the size and possible complexity of gaming environments, along with an increase in sophistication of the gaming devices themselves, a need exists for tracking a current progressive value (e.g., jackpot/award payouts) of a gaming device or devices in a particular gaming venue and providing this data to a user in real time for identifying particular gaming devices, current progressive awards, and the location of the gaming device, thereby allowing a user to quickly and efficiently identify the gaming devices paying out large and frequent awards and/or progressive jackpots.

In one embodiment, and as will be further described, the mechanisms of the illustrated embodiments operate as a roving helper, informing the user with up-to-date information (e.g., real-time data) those gaming "hot spots" (e.g., gaming devices and/or the location of the gaming devices that are participating in a progressive pool by awarding frequent and/or large (large being an amount defined by a gaming venue) award amounts, prizes, and progressive jackpots/values as compared with other gaming devices) by indicating and otherwise displaying the jackpot values, venues, and gaming devices/machines to players. This information, for example, may be accessible by an external application (e.g., a mobile phone/device application) and displayed according to a ranked order (e.g., rank from highest to lowest). A locator mechanism may be associated with the external application for providing directions and information (e.g., audio and visual directions, including but not limited to, pin mapping features, etc.). Thus a user is able to quickly and efficiently identify, locate, and use, if available, the gaming device. Accordingly, the player is directed to the most exciting areas (e.g., the hot spot gaming devices) within defined and participating venue(s), which may enrich the player's gaming experience and that of his/her associates.

In one embodiment, the user or group of users are provided with various filtering capabilities for displaying the hot spot gaming devices. For example, the user would be able to view for display the current progressive values of the ranked gaming devices based on an international, national, state, or venue specific region. Also, records of the most frequent and largest payout awards and progressive jackpots are maintained for display, including the most recent wins within the specified/selected regions thereby allowing other players to know what is happening in the gaming world around them.

In one embodiment, a gaming venue may be defined, including defining a number of the available gaming devices from which the universal progressive data feed is harvested and/or collected by controller and/or a monitoring system. The gaming venue may be defined as one or more casinos, one or more floors of the one or more casinos, a defined and/or restricted section of the one or more casinos, one or more of a specified gaming device (e.g., all video poker gaming devices), one or more of any combination of gaming devices, one or more gaming devices based on the manufacturer or owner, and/or single or multiple venues (e.g., a restaurant and/or a chain of convenience restaurants, a business and/or a chain of businesses, a convenience store and/or a chain of convenience stores, a hotel and/or a chain of hotels, an organization, and/or combination of any type of business, entity, and/or organization providing gaming entertainment, etc.). The venue may be defined at a local, regional, state, country, and/or international level. For example, a casino operator having multiple casinos throughout the world may define the gaming venue to be all casinos throughout the world, having a particular gaming device, to be the gaming venue for purposes of progressive value tracking. In another embodiment, by way of example only, a casino may define the gaming venue to be all gaming devices located on a specified floor (e.g., $1^{st}$ floor of the casino). In still an alternative embodiment, casinos owned and operated by different entities, having a business relationship, may define the gaming devices to only those gaming devices within the casinos of the business relationship. As one of ordinary skill in the art will appreciate, the applicable venue in which progressive value information is defined, collected and/or disseminated may vary according to business/organizational need, a particular application, or other factors.

The external application or other mechanism for processing and/or displaying the progressive information may include social media options (e.g., Facebook® or Twitter®) for uploading and posting to the social media network in which the users of the gaming device have memberships any awarded jackpot, value, and/or photograph and/or video. In addition, a scrolling text area may be provided for on the external application for advertising any exclusive and non-exclusive memberships, promotions, and/or offers. This data may be uploaded in real time from a software add on product from casino floor data to a cellular network, a wireless RLAN (Radio Local Area Network) standard, commercially known as WIFI®, Wi-Fi or WIFI or other type of communication channel for display via the external application.

In one embodiment, a vendor may specify and define the actual venue, which may also include defining specific gaming devices within the defined venue. For example, a casino may only allow specific types of gaming devices to be available to the user for the progressive value tracking within a localized region within a casino. Each of these specified gaming devices may be integrated with casino floor linked machine software data and may be fitted with a WIFI device. The data may then be shared locally via the WIFI device. Upon successful operation during a predetermined period of time, the data may be uploaded to mobile network with a link from venue to venue, state to state, and/or region to region. In addition to collecting the data into an existing software (e.g., IGT® casino link software), a standalone receiver may be used and linked to the transmitters built in to the machines. For example, a particular casino could be operated from closed networks for individual venues, prior to setting up a larger network. By allowing vendors of the gaming devices to specify a region or area, along with the type of gaming devices for tracking the current progressive values, the vendors no longer have to compete against other casino's/vendors offering jackpot offerings, promotion, and awards. Small and large venues would then be in control of the type of advertisements, promotions, and progressive values provided to the users.

In one embodiment, by use of a player tracking system, the vendors may provide for an exclusive membership club for users of the external application. A swipe card may be provided with the external application (e.g., mobile application, web application, computing applications and the like) to be used with the gaming device. In one embodiment, the external application provides a variety of options for online betting to casino tables, games, and sports books, and or other types of online gaming services. In one embodiment, the external application provides for a win selection/option allowing for the user/player to select upon hitting a jackpot or receiving a prize or award. The selection of the win feature would then instantly upload, to a social media network, a notification of the received award, jackpot, prize, the gaming device on with the user received the received award, jackpot, prize, and the venue of the gaming device, along with a small comment area for the winner. For example, the user may take a photograph of themselves along side the gaming device and upload to the social media or entire community using the external application/present invention with one click from the application. In addition, prize promotions may be offered to those who use the win button/option (e.g., a free gift may be offered) on the external application for publishing to the social media network the success within a specified venue.

Turning now to FIG. 1, a block diagram illustrating a gaming system environment 100 is shown. Environment 100 includes a Gaming Terminal Data Repository (GTDR) connected via one or more network interface(s) to a gaming network which, for example, may include gaming devices (e.g., gaming terminals) and/or other devices, in which aspects of the present invention may be realized. As illustrated in FIG. 1, the gaming environment 100 may comprise a gaming system/environment 122 located in a physical environment (not shown). It will be appreciated that the communications links between the various components may be separate and distinct or may be commonly used. It will also be appreciated that one or more of the functions or applications described above may be consolidated, such as at a common server or host. Further, other components for implementing other functionality may be provided. For example, a variety of computing devices, such as user stations, may be connected to the various systems. Printers and other peripheral devices may also be connected to each network or system. A gaming system/environment 122 may be located at least partially in one or more physical gaming environments, such as a casino, restaurant, and/or convenience store. For example, the casino may include publicly accessible game areas where certain of the gaming system devices 124, such as gaming machines 125 and table games 127 are located, as well as secure areas where the servers and other components are located.

In one embodiment, the physical environment includes at least a portion of a physical structure, such as casino, housing one or more components of the gaming system/environment 122. The gaming system/environment 122 includes one or more gaming system devices 124 or components. The gaming system devices 124 may include gaming machines 125, such as those known as video or slot machines. The devices 124 may also include "table" games 127 such as Blackjack and Roulette. The gaming devices 124 may also include components or devices such as player tracking card readers 129, coin counters and other gaming devices functionality options, which devices or components may be linked or associated with other devices. The devices or components may also comprise computers or servers and communication equipment, cashier and accounting workstations and a wide variety of other elements.

In one embodiment, the gaming system/environment 122 may include a variety of sub-systems. These sub-systems may be partially or fully independent of one another or may be related. In one embodiment, each system may be included or be part of a network. In one embodiment, the gaming system/environment 122 may include a game presentation/operation system, which includes at least one game server 126. The game server 126 may comprise a computing device including a processor and a memory. The game server 126 may be adapted to perform a variety of functions. This functionality may be implemented by software and/or hardware of the server 126. In one embodiment, the game server 126 may be arranged to provide information or instructions to the one or more gaming devices 124 or individual gaming system components. The information may comprise game code and control data. In one embodiment, the game server 126 may also be arranged to accept information from the gaming devices 124 or components. For example, the game sever 126 may accept information regarding the status of operation of a particular gaming system device 124 (such as "normal" or "malfunction").

In one embodiment, the game server 126 is part of a network, which includes a communication link between the game server 126 and selected gaming system device(s) 124 and/or other component(s) with which communication is desired. A communication interface may be associated with the game server 126 and each device or component for facilitating the communication. The communication interfaces may have a variety of architectures and utilize a variety of protocols such as IEEE-1394 (FireWire™) or Ethernet in the case where the communication link is a wired link, or a wireless link utilizing a wireless protocol such as WIFI, Bluetooth™, Radio Frequency (RF), Infrared, etc. The communication links may transmit electrical, electromagnetic or optical signals, which carry digital data streams, or analog signals representing various types of information. In one embodiment, such as when the gaming device 124 comprises a gaming machine 125, the device 124 may include a master gaming controller, which controls the functions of game operation. The communication interface may be associated with the master gaming controller, permitting data to be transmitted between the game server 126 and the master gaming controller.

In one embodiment, the gaming system/environment 122 may include a player tracking system, which includes at least one player-tracking server 128. The player-tracking server 128 may also comprise a computing device including a processor and a memory. The player-tracking server 128 may be adapted to perform player-tracking functions. For example, the player-tracking server 128 may store information regarding the identities of players and information regarding the game play of those players. This information may include time of play, coin in/coin out or other monetary transaction data, and in an arrangement where players are awarded points based on play, a player's point total. Once again, the player tracking system includes a network comprising a communication link provided between the player tracking server 128 and one or more of the gaming devices 124 having a player tracking function or other components of the gaming system/environment 122 associated with the system. In one embodiment, such as where the gaming device 124 comprises a gaming machine, the device may include a management interface board, which controls a card reader. The management interface board may be arranged to receive data from the master gaming controller of the gaming system device 124. A communication interface is associated with the management interface board, permitting data to be transmitted between the player tracking server 128 and the management interface board.

In the case of table games, a card reader 129 may be associated with the table (e.g., the card reader located on or near the table game). Players may utilize the card reader to identify themselves. Information regarding play of the table game may be input through an input device by a dealer, coin counter or the like, and this information may be transmitted to the player tracking server 128.

In one embodiment, the gaming system/environment 122 may include an accounting system, which includes at least one accounting server 130. The accounting server 130 may comprise a computing device including a processor and a memory. The accounting server 130 is preferably adapted to perform financial related functions, such as track financial transactions such as bets and payouts, and perform reconciliations with monies collected from the gaming system devices 124, such as gaming machines 125, tables games 127. The accounting server 30 may be associated with a wide variety of devices, including individual gaming system devices 124 and other servers. Once again, a communication link may be provided between the accounting server 130 and each device with which communications is desired.

In one embodiment, the gaming system/environment 122 may include a progressive award system, which includes at least one progressive server 132. The progressive sever 132 may comprise a computing device including a processor and a memory. The progressive server 132 may be designed to generate progressive award information. In one arrangement, the progressive server 132 may obtain information regarding amounts bet at specific gaming system devices 124, such as gaming machines 125 or table games 127. Utilizing this information, a progressive jackpot award amount may be generated and updated using a specified protocol. The information may be transmitted to one or more displays 134 associated with participating devices 124. Once again, a communication link is preferably provided between the progressive server 132 and each device with which communications is desired. For example, a link may be provided between the progressive server 132 and accounting server 130 for providing payout information to the accounting server 130. The accounting server 130 also reads the paid amounts from the electronic gaming machines 125 as well and makes sure the paid amounts match what the progressive server claimed the paid amounts should have been. If the paid amounts don't match, then the accounting server 130 may raise a flag for further investigation by casino staff or regulators.

A virtual information host 136 is associated with or comprises a portion of the gaming system/environment 122. In one embodiment, the host 136 comprises a computing device, which includes a processor, memory and a display. The virtual information host 136 may be one or more devices separate from devices performing other functions of the system/environment 122, or may be integrated with existing devices. The virtual information host 136 may be designed and adapted to perform functions relating to acquiring, managing, rendering, generating and/or displaying real-time and/or non real-time casino gaming system or "gaming environment" graphical information and information regarding one or more components of the gaming system or environment. Such functionality may also include the generation of at least one graphical user interface on at least one mobile device (e.g., 131), which is configured or designed to graphically display information (e.g., real-time casino information) relating to selected aspects of casino activity. Also, different graphical user interfaces may be displayed on an external application, such as on an application of a computer, smart phone, and/or on any type of mobile device 131. In one embodiment, bi-directional communication channels 121 are provided for direct, two-way communication between the host 136 and at least one game server 126 and at least one player-tracking server 128, and/or any other device with which communications is desired.

As illustrated in the example of FIG. 1, gaming system/environment 122 may also include one or more mobile devices 131 configured or designed to communicate, via one or more wireless links 111, with various components of the gaming environment 100 such as, for example: information systems (e.g., virtual information host 136); player tracking systems; accounting systems; employee management systems; location positioning systems (e.g., GPS system 133); game servers; surveillance systems; security systems; communications systems; gaming systems (e.g., gaming machines 125, game table devices 127, other mobile devices 125, etc.); etc.

Figure 2:
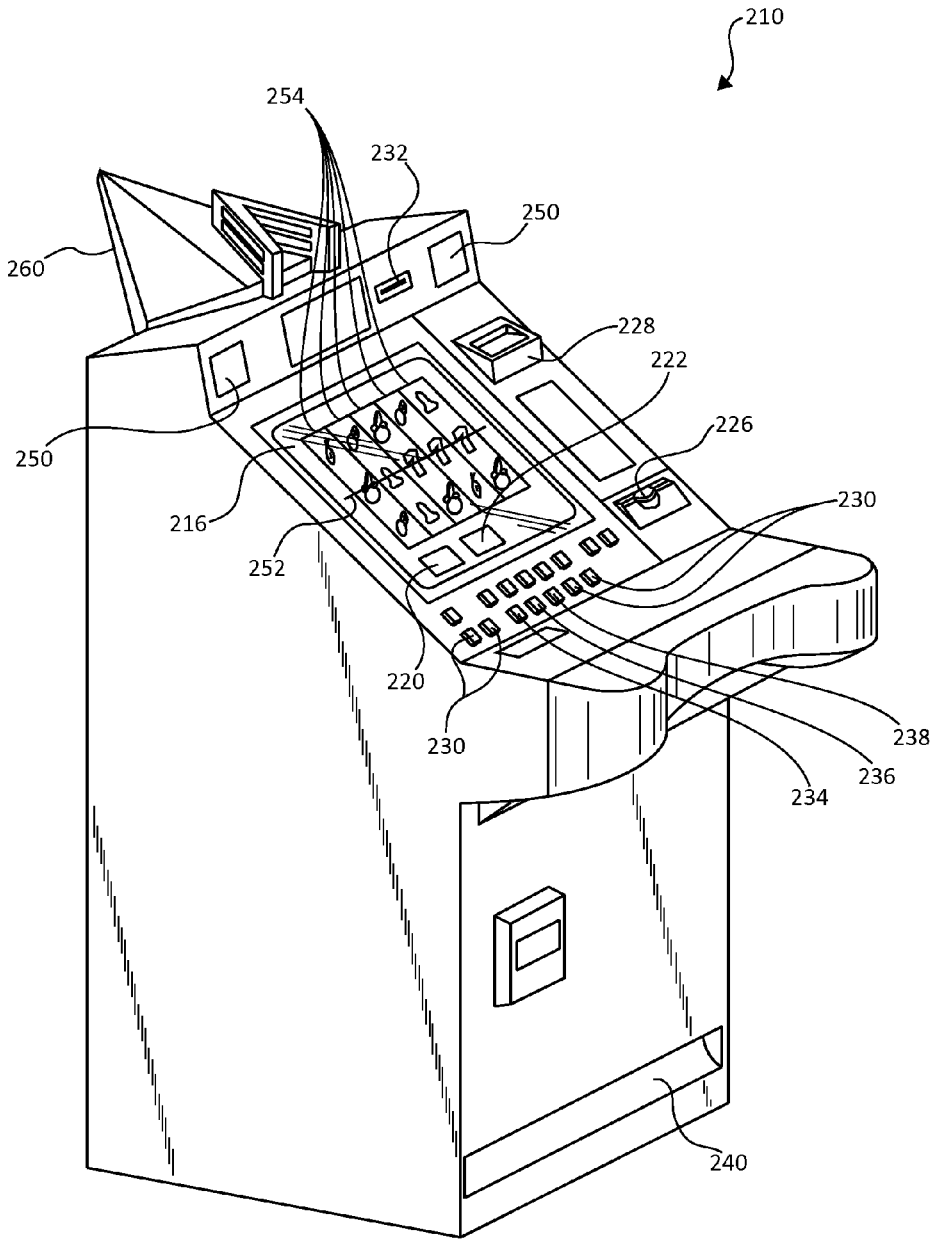
FIG. 2 is a perspective view of one embodiment of a slot machine or gaming device suitable for use in the gaming system of FIG. 1, in which aspects of the present invention may be realized.

FIG. 2 is a perspective view of one embodiment 210 of a slot machine or gaming device suitable for use in the previously depicted system of FIG. 1, in which aspects of the present invention may be realized. FIG. 2 represents a base gaming device 210 that can be employed in the shared display system or the gaming system of the present invention is illustrated as gaming device 210. FIG. 2 illustrates features common to each of the gaming devices. In one embodiment, gaming device 210 has a support structure, housing or cabinet, which provides support for a plurality of displays, inputs, controls and other features of a conventional gaming machine. In the illustrated embodiment, the player plays gaming device 210 while sitting, however, the gaming device is alternatively configured so that a player can operate it while standing or sitting. The illustrated gaming device 210 is positioned on the floor but can be positioned alternatively (i) on a base or stand, (ii) as a pub-style table-top game (e.g., where the participant gaming devices are located remotely from the shared wheel as discussed below), (iii) as a stand-alone gaming device on the floor of a casino with other stand-alone gaming devices, which the player operates while standing or sitting (e.g., where the participant gaming devices are located remotely from the shared wheel as discussed below), or (iv) in any other suitable manner. The gaming device 210 can be constructed with varying cabinet and display configurations. Also, referring to an embodiment for the electronic configuration of gaming device 210, each gaming device may include the components described below in FIG. 3A and FIG. 3B.

In one embodiment, each gaming device 210 randomly generates awards and/or other game outcomes based on probability data. That is, each award or other game outcome is associated with a probability and each gaming device generates the award or other game outcome to be provided to the player based on the associated probabilities. Since each gaming device 210 generates outcomes randomly or based upon a probability calculation, there is no certainty that the gaming device 210 will provide the player with any specific award or other game outcome.

In another embodiment, as discussed in more detail below, each gaming device 210 employs a predetermined or finite set or pool of awards, progressive awards, prizes or other game outcomes. As each award or other game outcome is provided to the player, the gaming device 210 removes the provided award or other game outcome from the predetermined set or pool. Once removed from the set or pool, the specific provided award or other game outcome cannot be provided to the player again. The gaming device 210 provides players with all of the available awards or other game outcomes over the course of the play cycle and guarantees a designated amount of actual wins and losses.

Figure 3A:
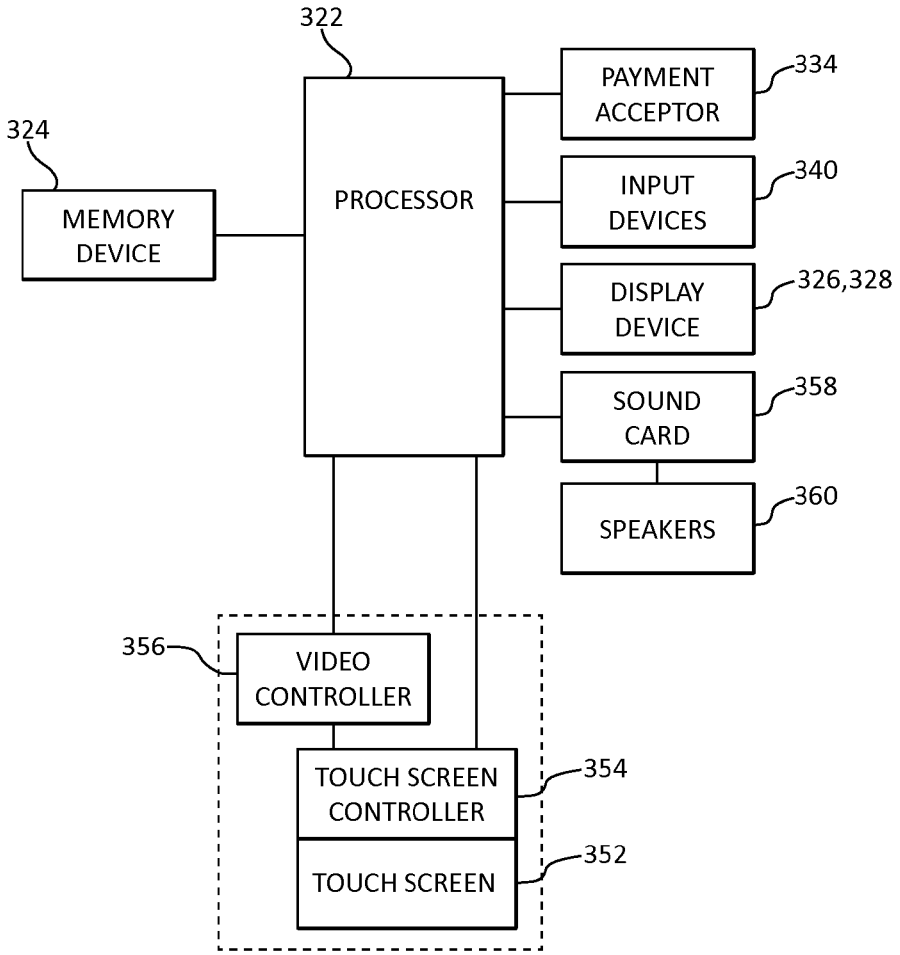
FIG. 3A is a block diagram illustrating an electronic configuration for use in the gaming device of FIG. 2, in which aspects of the present invention may be realized.

As seen in FIG. 2, the gaming device 210 includes a credit display 220 that displays a player's current number of credits, cash, account balance or the equivalent. In one embodiment, gaming device 210 includes a bet display 222 that displays a player's amount wagered. As illustrated in FIG. 3A, in one embodiment, each gaming device 210 includes at least one payment acceptor 334 (FIG. 3A) that communicates with processor 322 (FIG. 3A).

As seen in FIG. 2, the payment acceptor 334 (FIG. 3A) in one embodiment includes a coin slot 226, where the player inserts coins or tokens, and a ticket, note or bill acceptor 228, where the player inserts a bar-coded ticket, note, or cash. In one embodiment, a player-tracking card, credit card, debit card or data card reader/validator 232 is also provided for accepting any of those or other types of cards.

In one embodiment, a player inserts an identification card into card reader 232 of gaming device 210. The identification card can be a smart card having a programmed microchip or a magnetic strip coded with a player's identification, credit totals and other relevant information. In one embodiment, money may be transferred to gaming device 10 through an electronic fund transfer and card reader 232 using the player's credit, debit or smart card. When a player funds gaming device 210, processor 322 (FIG. 3A) determines the amount of funds entered and the corresponding amount is shown on the credit or other suitable display as described above. In one embodiment, after appropriate funding of gaming device 210, the player presses a play button 234 or pull arm (not illustrated) to start any primary game or sequence of events. In one embodiment, upon appropriate funding, gaming device 210 begins game play automatically. In another embodiment, the player needs to actuate or activate one of the play buttons to initiate play of gaming device 210.

As shown in FIG. 2, a bet one button 236 is provided. The player places a bet by pushing bet one button 236. The player increases the player's wager by one credit each time the player pushes bet one button 236. When the player pushes the bet one button 236, the number of credits shown in the credit display 220 decreases by one, and the number of credits shown in the bet display 222 increases by one. A max bet max button (not shown) can also be provided, which enables the player to bet the maximum wager (e.g., max lines and max wager per line). Gaming device 210 may include other suitable wager buttons 230, such as a max bet button, a repeat bet button, one or more select paylines buttons and one or more select wager per payline buttons.

In one embodiment, a cash out button 238 is provided. The player presses cash out button 238 and cashes out to receive a cash payment or other suitable form of payment corresponding to the number of remaining credits. The player can receive coins or tokens in a coin payout tray 240 or a ticket or credit slip, which are redeemable by a cashier or funded to the player's electronically recordable identification card. Each gaming device 210 also includes one or a plurality of communication ports for enabling communication of a processor with one or more external peripherals, such as external video sources, expansion buses, expansion games or other displays, an SCSI port or a key pad.

In one embodiment of FIG. 2, in combination with in FIG. 3A, a touch-screen 352 (FIG. 3A) is provided in one embodiment and operates with a touch-screen controller 354, processor 322 (FIG. 3A) and display device 326,328 (FIG. 3A). Touch-screen 352 (FIG. 3A) and the touch-screen controller 354 are also connected to a video controller 356. The player touches touch-screen 352 at appropriate places to input decisions and signals into processor 322 of gaming device 210. Also, each gaming device 210 may include a sound generating device controlled by one or more sounds cards 258, which function in conjunction with processor 322 (FIG. 3A). In one embodiment, the sound generating device includes at least one speaker 250 or other sound generating hardware and/or software for generating sounds, such as playing music for the primary and/or secondary game or for other modes of the gaming device, such as an attract mode. In one embodiment, each gaming device 210 provides dynamic sounds coupled with attractive multimedia images displayed on display device 216 to provide an audio-visual representation or to otherwise display full-motion video with sound to attract players to gaming device 210. During idle periods, the gaming device 210 displays a sequence of audio and/or visual attraction messages to attract potential players to gaming device 210. The videos in one embodiment are customized to provide information concerning the shared display of the present invention as discussed below.

In one embodiment, gaming device 210 includes a camera in communication with a processor, which is positioned to acquire an image of a player playing gaming device 10 and/or the surrounding area of gaming device 10. In one embodiment, the camera may be configured to selectively acquire still or moving (e.g., video) images and may be configured to acquire the images in either an analog, digital or other suitable format. Display device 216 may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

In one embodiment, as illustrated in FIG. 2, a base or primary game includes a slot game with one or more paylines 252. Paylines 252 may be horizontal, vertical, circular, diagonal, angled or any combination thereof. For a slot game, gaming device 210 displays at least one reel and preferably a plurality of reels 254, such as three to five reels, in either electromechanical form with mechanical rotating reels or in video form with simulated reels and movement thereof. Each reel 254 displays a plurality of indicia such as bells, hearts, fruits, numbers, letters, bars or other images, which preferably correspond to a theme associated with the gaming device. With a slot game, gaming device 10 awards prizes when reels 254 stop spinning and display a winning or paying symbol or combination of symbols on an active payline 252.

In one embodiment, each gaming device 210 includes indicators 260. Indicators 260 reside on the top of each gaming device 10 and point to or indicate one of the awards or outcomes on top of shared display (not shown) when the shared display stops spinning to reveal randomly or otherwise generated results or outcomes. Indicators 260 may illuminate differently at different times or states for the gaming device 210. The illumination of the indicator 260 in one embodiment depends upon whether the gaming device 210 is playing a base game, is in a state in which the player is eligible to play the shared display bonus, is in a state in which the player has committed to play the shared display bonus or is in a state in which the player has declined to play a particular upcoming shared display bonus, as well as other states discussed below.

FIG. 3A is a block diagram illustrating an electronic configuration for use in the gaming device of FIG. 2, here again in which aspects of the present invention may be realized. In the embodiment illustrated in FIG. 3A the player station may include at least one processor 322, such as a microprocessor, a microcontroller-based platform, a suitable integrated circuit or one or more ASICs. The processor 322 is in communication with or operable to access or to exchange signals with at least one data storage or memory device 324. In one embodiment, the processor 322 and the memory device 324 reside within the cabinet of the player station. The memory device 324 stores program code and instructions, executable by the processor 322, to control the player station. The memory device 324 also stores other data such as image data, event data, player input data, random or pseudo-random number generators, pay-table data or information and applicable game rules that relate to the play of the player station. In one embodiment, the memory device 324 includes random access memory (RAM), which can include non-volatile RAM (NVRAM), magnetic RAM (MRAM), ferroelectric RAM (FeRAM) and other forms as commonly understood in the gaming industry. In one embodiment, the memory device 324 includes read only memory (ROM). In one embodiment, the memory device 324 includes flash memory and/or EEPROM. Any other suitable magnetic, optical and/or semiconductor memory may operate in conjunction with the player station and gaming system disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming system is operable over a wireless network, such as part of a wireless gaming system. In this embodiment, the player station may be a hand held device, a mobile device or any other suitable wireless device that enables a player to play any suitable game at a variety of different locations. It should be appreciated that a player station as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, a background play feature may be available where a player, who may be sitting at the lounge and/or at the bar with friends (at the casino) may be playing a machine from the floor by remote via the external application (e.g., a smart phone). The player may substitute into the same game he wanted from an IGT online game and play, or back-end the actual game though a venue network. The game may be bankrolled by the venue the player was inside. If the player was to win the player could collect from that venue where the player was located, and/or instead of "reserving" a machine he could continue the game with an auto play during a period of time the player took a break/recess. In one embodiment, a team game may be played by a group of players (e.g., a group of 3 or 4 players) and the group of players may watch and/or play the same game on each players individual external device (e.g., a computer and/or smart phone). Similarly, as described above, the team game may be played by a group of players from a remote location (e.g., bar, lounge, casino, home, office, restaurant, etc.). In one embodiment, the team game may be played by a group of players and the group of players may share credit inputs and wins. In one embodiment, the team game may be played by the group of players and the group of players may sell off and/or share double up options and/or credits to others team players of the group.

In one embodiment, as discussed in more detail below, the gaming device randomly generates awards and/or other game outcomes based on probability data. In one such embodiment, this random determination is provided through utilization of a Random Number Generator (RNG), such as a true random number generator, a pseudo random number generator or other suitable randomization process. In one embodiment, each award or other game outcome is associated with a probability and the player station generates the award or other game outcome to be provided to the player based on the associated probabilities. In this embodiment, since the player station generates outcomes randomly or based upon one or more probability calculations, there is no certainty that the player station will ever provide the player with any specific award or other game outcome. In another embodiment, each award or other game outcome is associated with a probability and the central controller or server generates the award or other game outcome to be provided to the player based on the associated probabilities. In one embodiment, each of the player stations includes an RNG and the central server controls the display of the central display. It should be appreciated there may be one or more RNG's per: (a) display segment; (b) central display; (c) player station; (d) number of games; (e) the number of potential games; or (f) any combination of the above. It should also be appreciated that one or more processors may work together and communicate to accomplish any suitable function of the gaming system.

In another embodiment, the gaming system employs a predetermined or finite set or pool of awards or other game outcomes. In this embodiment, as each award or other game outcome is provided to the player, the central controller flags or removes the provided award or other game outcome from the predetermined set or pool. Once flagged or removed from the set or pool, the specific provided award or other game outcome from that specific pool cannot be provided to the player again. This type of gaming system provides players with all of the available awards or other game outcomes over the course of the play cycle and guarantees the amount of actual wins and losses.

In one embodiment, as mentioned above and seen in FIG. 3A, one input device is a touch-screen 352 coupled with a touch-screen controller 354, or some other touch-sensitive display overlay to allow for player interaction with the images on the display. The touch-screen and the touch-screen controller are connected to a video controller 356. A player can make decisions and input signals into the player station by touching the touch-screen at the appropriate places. One such input device is a conventional touch-screen button panel. In another embodiment, a plurality or each of the display segments is a touch-screen 352 coupled with a touch-screen controller 354 or some other touch-sensitive display overlay to allow for player interaction with the images on the display segments. The touch-screens 352 and the touch-screen controllers 354 are connected to a video controller. The player station may further include a plurality of communication ports for enabling communication of the processor with external peripherals, such as external video sources, expansion buses, game or other displays, an SCSI port or a key pad. In one embodiment, at least one payment acceptor 324 that communicates with processor 322 for playing a bet, input devices 340, and display devices 326,328 are provided.

The player stations, the central controller and the display segments may include serial interfaces to connect to specific subsystems or subnets internal and external to the player stations, central controller and the display segments. The serial devices may have electrical interface requirements that differ from the "standard" EIA serial interfaces provided by general-purpose computers. These interfaces may include EIA, EIA, Fiber Optic Serial, optically coupled serial interfaces, current loop style serial interfaces, etc. In addition, to conserve serial interfaces internally in the player station, serial devices may be connected in a shared, daisy-chain fashion where multiple peripheral devices are connected to a single serial channel.

The serial interfaces may be used to transmit information using communication protocols that are unique to the gaming industry. For example, SAS is a communication protocol used to transmit information, such as metering information, from a player station to a remote device. Often SAS is used in conjunction with a player tracking system. Player stations may be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. In one embodiment, security-monitoring circuits detect intrusion into a player station or gaming station by monitoring security switches attached to access doors in a designated area, such as a player station cabinet. In one embodiment, access violations result in suspension of game play and can trigger additional security operations to preserve the current state of game play. These circuits also function when power is off by use of a battery backup. In one embodiment, as seen in FIG. 3A, the player station includes a sound generating device controlled by one or more sounds cards 358 which function in conjunction with the processor. In one embodiment, the sound generating device includes at least one and preferably a plurality of speakers 360 or other sound generating hardware and/or software for generating sounds, such as playing music for the primary and/or secondary game or for other modes of the player station, such as an attract mode. In one embodiment, the player station provides dynamic sounds coupled with attractive multimedia images displayed on one or more of the display devices to provide an audio-visual representation or to otherwise display full-motion video with sound to attract players to the player station. During idle periods, the player station may display a sequence of audio and/or visual attraction messages to attract potential players to the player station. The videos may also be customized for or to provide any appropriate information.

In one embodiment, the gaming system may include a sensor, such as a camera in communication with the processor (and possibly controlled by the processor) that is selectively positioned to acquire an image of a player actively using the player station and/or the surrounding area of the player station. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia. In another embodiment, the gaming system includes a wireless transceiver or a camcorder and the display segments are components of or are connected to televisions, satellites, DVD players, digital video recorders and Internet-enabled devices. In one embodiment, the game may be displayed on the central display and replicated on one or more the player stations. In another embodiment, the game is only displayed on the central display and the player station is only used to input decisions or commands in the game. In another embodiment, a primary or base game is displayed on the player station and/or the central display and one or more bonus games are displayed on the central display only. In one embodiment, the player stations provide other information to a player, such as the win/loss history of that certain games or the win/loss history of that player. It should be appreciated that the central display and the player stations may work together with a central controller or a plurality of servers to provide the games to the player in any suitable manner.

Figure 3B:
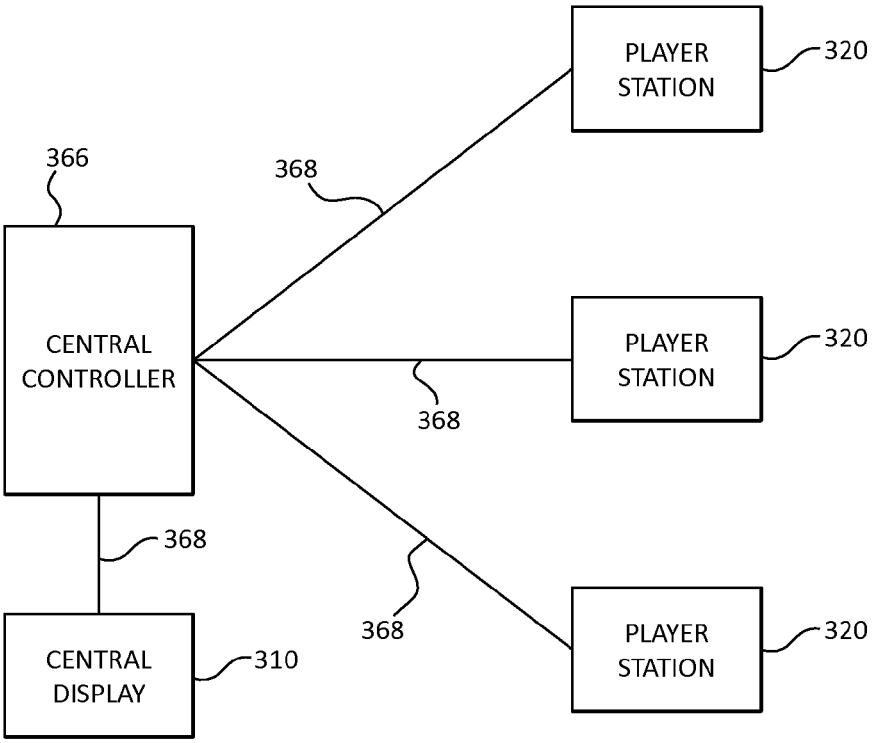
FIG. 3B is a block diagram illustrating player stations in communication with a central controller and a central display in communication with the central controller for use in the gaming device of FIG. 2, in which aspects of the present invention may be realized.

FIG. 3B is a block diagram illustrating a player station 320 in communication with a central controller and a central display 310 in communication with the central controller for use in the gaming device of FIG. 2, in which aspects of the present invention may be realized. In one embodiment, as illustrated in FIG. 3B, one or more of the player stations 320 are in communication with each other and/or at least one central server, central controller or remote host 366 through a data network or remote communication link 368. The central server, central controller or remote host is any suitable server or computing device, which includes at least one processor and at least one memory or storage device, and may also be in communication with a central display 310. In other embodiments, the central server is a progressive controller or a processor of one of the player stations in the gaming system. In these embodiments, the processor of each player station is configured to transmit and receive events, messages, commands, a current progressive value or any other suitable data or signal between the individual player station and the central server. The player station processor is operable to execute such communicated events, messages or commands in conjunction with the operation of the player station. Moreover, the processor of the central server is configured to transmit and receive events, messages, commands or any other suitable data or signal between the central server and each of the individual player stations. The central server processor is operable to execute such communicated events, messages or commands in conjunction with the operation of the central server. It should be appreciated that one or more of each of the functions of the central controller may be performed by one or more player station processors. It should be further appreciated that one, more or each of the functions of one or more player station processors as disclosed herein may be performed by the central controller. In one embodiment, the central controller has an Uninterruptible Power Supply ("UPS"). In one embodiment, the UPS is a rack mounted UPS module.

In one embodiment, the game outcome provided to the player is determined by a central server or controller and provided to the player at the player station. In this embodiment, each of the player stations is in communication with the central server or controller. Upon a player initiating game play at one of the player stations, the initiated player station communicates a game outcome request to the central server or controller. In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. The central server or controller is capable of storing and utilizing program code or other data similar to the processor and memory device of the player station. In an alternative embodiment, the central server or controller maintains one or more predetermined pools or sets of predetermined game outcomes. The central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes. The central server or controller communicates the generated or selected game outcome to the initiated player station. The player station receives the generated or selected game outcome and provides the game outcome to the player. In an alternative embodiment, how the generated or selected game outcome is to be presented or displayed to the player, such as a reel symbol combination of a player station or a hand of cards dealt in a card game, is also determined by the central server or controller and communicated to the initiated player station to be presented or displayed to the player. Central production or control can assist a gaming establishment or other entity in maintaining appropriate records, controlling gaming, reducing and preventing cheating or electronic or other errors, reducing or eliminating win-loss volatility.

In one embodiment, the player stations disclosed herein are associated with or otherwise integrated with one or more player tracking systems. In this embodiment, the player station and/or player tracking system tracks players gaming activity at the player station. In one such embodiment, the player station and/or associated player tracking system timely tracks when a player inserts their playing tracking card to begin a gaming session and also timely tracks when a player removes their player tracking card when concluding play for that gaming session. In another embodiment, rather than requiring a player to insert a player-tracking card, the player station utilizes one or more portable devices carried by a player, such as a cell phone, a radio frequency identification tag or any other suitable wireless device to track when a player begins and ends a gaming session. In another embodiment, the player station utilizes any suitable biometric technology or ticket technology to track when a player begins and ends a gaming session. During one or more gaming sessions, the player station and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. The player stations are capable of being connected together through a data network. In one embodiment, the data network is a local area network (LAN), in which one or more of the player stations are substantially proximate to each other and an on-site central server or controller as in, for example, a gaming establishment or a portion of a gaming establishment. In another embodiment, the data network is a wide area network (WAN) in which one or more of the player stations are in communication with at least one off-site central server or controller. The player stations may be located in a different part of the gaming establishment or within a different gaming establishment than the off-site central server or controller. Thus, the WAN may include an off-site central server or controller and an off-site player station located within gaming establishments in the same geographic area, such as a city or state. The WAN gaming system may be substantially identical to the LAN gaming system described above, although the number of player stations in each system may vary relative to each other.

In one embodiment, as a benefit to one or more of the gaming venues (e.g., a casino), using the player tracking system, along with use of the GPS positioning, for identifying the movements of the players throughout the gaming venues, identifying cash, money, credits, and award amounts spent along with various trends (e.g., historical) for generating visual graphs while displaying showing top view of the gaming venue (e.g., looking down from above the gaming venue) to improve casino layouts and identify patterns an movements of all types of players.

In another embodiment, the data network is an Internet or intranet. The operation of the player station can be viewed at the player station with at least one Internet browser. Operation of the player station and accumulation of credits may be accomplished with only a connection to the central server or controller (the internet/intranet server) through a conventional phone or other data transmission line, digital subscriber line (DSL), T-1 line, coaxial cable, fiber optic cable, WIFI, or other suitable connection. Players may access an Internet game page from any location where an Internet connection and computer, or other Internet facilitator is available. The expansion in the number of computers and number and speed of Internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In another embodiment, as described above, the gaming system is in communication with a central server or controller. The central server or controller may be any suitable server or computing device, which includes at least one processor and a memory or storage device. In alternative embodiments, the central server is a progressive controller or another player station in the gaming system. In one embodiment, the memory device stores different game programs and instructions, executable by a player station processor, to control the player station. Each executable game program represents a different game or type of game, which may be played on one or more of the player stations in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the player station) or vice versa.

In this embodiment, one, all or a plurality of the player stations at least includes one or more display devices and/or one or more input devices for interaction with a player. A local processor, such as the above-described player station processor or a processor of a local server, is operable with the display device(s) and/or the input device(s) of one or more of the player stations. In operation, the central controller is operable to communicate one or more of the stored game programs to at least one local processor. In different embodiments, the stored game programs are communicated or delivered by embedding the communicated game program in a device or a component (e.g., a "chip" to be inserted in a player station), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the player station. That is, when a game program is communicated to a local processor, the local processor changes the game or type of game played at the player station or displayed on the display segment. Though the illustrated embodiments are described with the central controller determining a game result for the player and communicating that result to the central display 310 and one or more player stations, any other suitable game determining method may be employed in any embodiment of the present disclosure. In one embodiment, the central display 310 is associated with a central display 310 server. This central display 310 server determines the game outcome for the games played on each of the display segments. The central display 310 server communicates the game outcome to the central controller, which communicates the game outcome to one or more of the player stations.

In one embodiment, the central controller determines the award to provide to the player based on the game outcome. In another embodiment, the player stations determine the award and/or progress jackpot/value to provide to the players based on the game outcomes. In another embodiment, the central controller determines the game outcome displayed on the central display 310 and the player station determines any award and/or progress jackpot/value to provide to the player based on the game outcome. The player station determines both the game outcome and any award to provide to the player based on the game out come. In another embodiment, the central controller determines part of the outcome and the player station determines part of the outcome. That is, both the central controller and the player station determine part of a player's outcome and/or award.

Further, in the gaming industry, many different manufacturers make gaming machines and player stations. The communication protocols on the player station may be hard-wired into the player station and each player station/gaming machine manufacturer may utilize a different proprietary communication protocol. A player station manufacturer may also produce host systems, in which case their player stations are compatible with their own host systems. However, in a heterogeneous gaming environment, player stations from different manufacturers, each with its own communication protocol, may be connected to host systems from other manufacturers, each with another communication protocol. Therefore, communication compatibility issues regarding the protocols used by the player stations in the system and protocols used by the host systems must be considered.

In another embodiment, player stations at one or more gaming sites may be networked to a central server in a progressive configuration, wherein a portion of each wager to initiate a base or primary game may be allocated to bonus or secondary event awards. In one embodiment, a host site computer is coupled to central servers at a variety of mutually remote gaming sites for providing a multi-site linked progressive automated gaming system. The host site computer may serve player stations distributed throughout a number of properties at different geographical locations including, for example, different locations within a city or different cities within a state. The host site computer may be maintained for the overall operation and control of the system. A host site computer may oversees the entire progressive gaming system and may be the master for computing all progressive jackpots and values for each and every gaming device. All participating gaming sites report to, and receive information from, the host site computer. Each central server computer may be responsible for all data communication between the player station hardware and software and the host site computer. An individual player station may trigger a progressive win, for example through a game play event such as a symbol-driven trigger in the multi-component game. The central server or other central controller determines when a progressive win is triggered. The central controller and an individual player station may work in conjunction with each other to determine when a progressive win is triggered, for example through an individual player station meeting a predetermined requirement established by the central controller. The progressive award win may be triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a player station is randomly or apparently randomly selected to provide a player of that player station one or more progressive awards. In one such embodiment, the player station does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game. In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards).

In one such embodiment, the greater the players' wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner. In another embodiment, one or more of the progressive awards are partially funded via a side-bet or side-wager, which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed. In one alternative embodiment, a minimum wager level is required for a player station to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, players at a linked player stations in a gaming system participate in a group gaming environment. In one embodiment, players at linked player stations work in conjunction with one another, such as playing together as a team or group, to win one or more awards. In one such embodiment, any award won by the group is shared, either equally or based on any suitable criteria, amongst the different players of the group. In another embodiment, players linked player stations compete against one another for one or more awards. In one such embodiment, players at linked player stations participate in a gaming tournament for one or more awards. In another embodiment, players at linked player stations play for one or more awards wherein an outcome generated by one player station affects the outcomes generated by one or more linked player stations.

Figure 4:
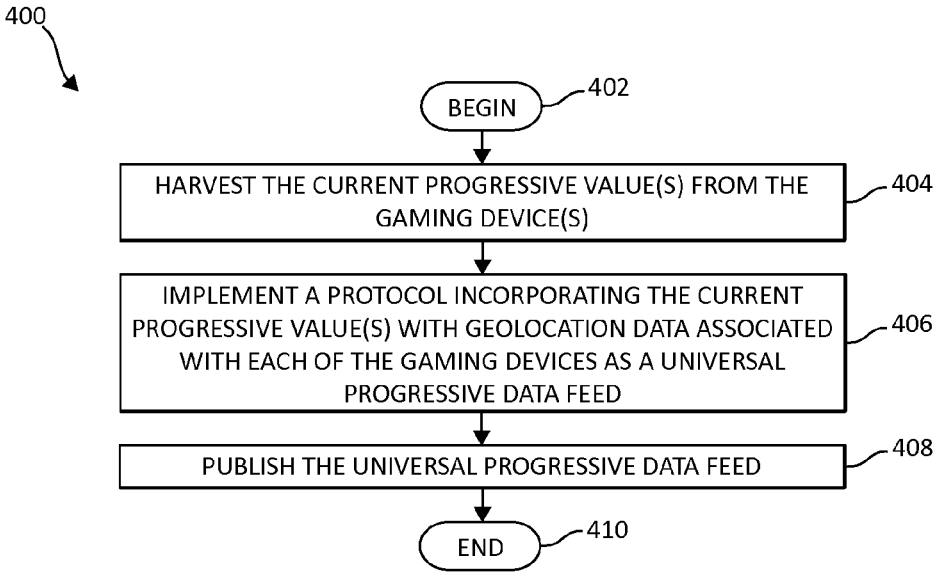
FIG. 4 is a flow chart illustrating an exemplary method for progressive value tracking.

FIG. 4 is a flow chart illustrating an exemplary method 400 for progressive value tracking in which aspects of the present invention may be realized. The method 400 begins (step 402) by harvesting the current progressive value(s) from the gaming device(s) (step 404). The method 400 implements a protocol incorporating the current progressive value(s) with geolocation data associated with each of the gaming devices as a universal progressive data feed (step 406). The universal progressive data feed is published to be accessible, for example, to the external application (step 408). The method 400 ends (step 410).

Figure 5:
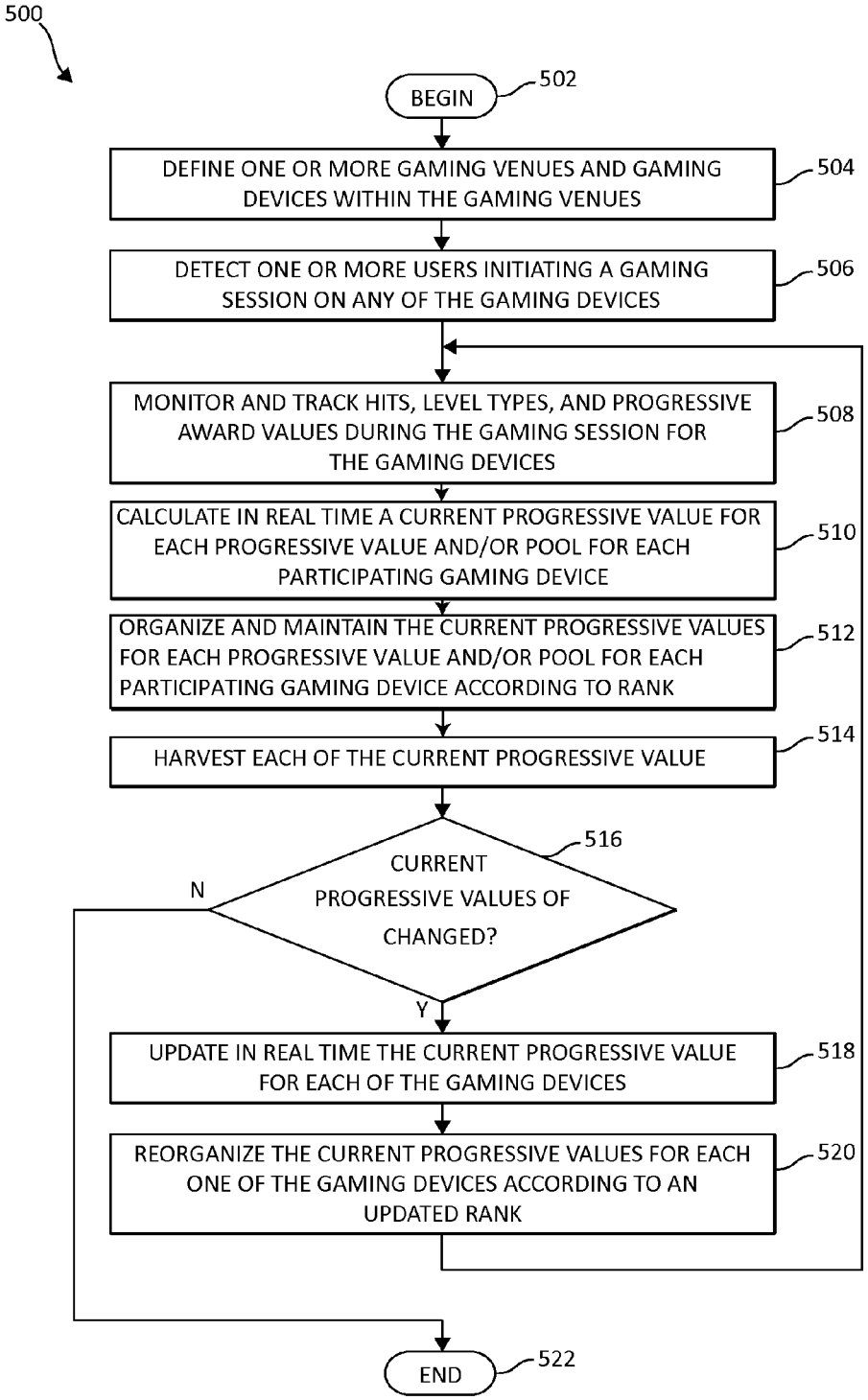
FIG. 5 is a flow chart illustrating an exemplary method for processing a current progressive value.

The process of harvesting the current progressive value and implementing the protocol is further described in greater detail in FIG. 5. FIG. 5 is a flow chart illustrating an exemplary method 500 for processing a current progressive value in which aspects of the present invention may be realized. The method 500 begins (step 502) by defining one or more gaming venues and gaming devices within the gaming venues (step 504). One or more users are detected when initiating a gaming session on any of the gaming devices (step 506). The method 500 monitors and track hits, level types, and progressive award values during the gaming session for the gaming devices (step 508). In one embodiment, the progressive award values maybe the progressive level itself and/or may be the value of a progressive level when a "hit" occurred. In one embodiment, the progressive award is an award amount, which includes an initial amount, funded by a casino and an additional amount funded through a portion of each wager made on the progressive gaming machine. As such, the progressive awards may grow in value as more players play a gaming machine and more portions of the players' wagers are allocated to the progressive award. Moreover, in one embodiment, the progressive award may be associated with a single gaming machine or multiple gaming machines which each contribute portions of the progressive award. The multiple gaming machines may be in the same bank of machines, in the same casino or gaming establishment (usually through a local area network ("LAN")) or in two or more different casinos or gaming establishments (usually through a wide area network ("WAN")). Such the progressive award may be referred to as local area progressives ("LAP") and wide area progressives ("WAP"), respectively.

The method 500 will calculate in real time a current progressive value for each progressive value and/or pool for each participating gaming device (step 510). The current progressive value is representative of a fixed award, a progressive award, and/or a combination of the fixed award and the progressive award. The method 500 may organize and maintain the current progressive values for progressive value and/or pool for each participating gaming device according to rank (step 512). Each of the current progressive values is harvested from the gaming devices (step 514). The method 500 then determines and checks if any current progressive values of any of the progressive values and/or pools for each participating gaming device (step 516). In one embodiment, this may apply to a single EGM contributing to a stand-alone progressive level and/or may be for an EGM contributing to linked-progressive levels where multiple EGM's are contributing. If any current progressive values of any of the gaming devices have not changed, the method 500 ends (step 520). If yes, the method 500 updates in real time the current progressive value for each of the gaming devices (step 518). The method 500 may then reorganize the current progressive values for each one of the gaming devices according to an updated rank (step 520). Upon conclusion, the method 500 may either end (step 520) and/or return to monitor and track hits, level types, and progressive award values during the gaming session for the gaming devices (step 508).

Figure 6:
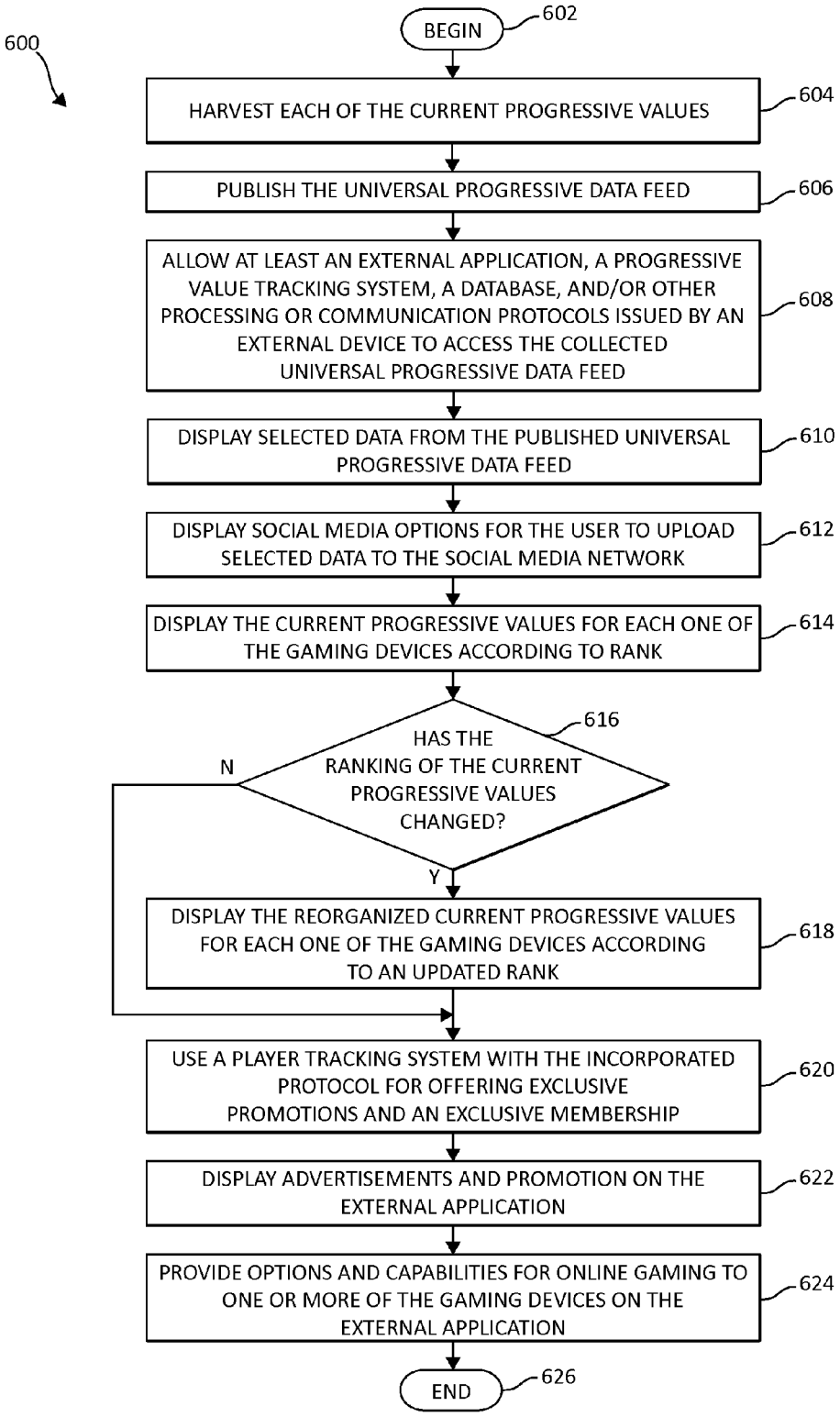
FIG. 6 is a flow chart illustrating an exemplary method for publishing the current progressive value to be accessible to an external device.

FIG. 6 is a flow chart illustrating an exemplary method 600 for publishing the current progressive value to be accessible, for example, to an external device. The method 600 begins (step 602) by harvesting the current progressive value(s) from the progressive values and/or pools for each participating gaming device (see FIG. 5 step 514) (step 604). The universal progressive data feed is published to be accessible for further processing and access (step 606). The method 600 allows at least an external application, a progressive value tracking system, a database, and/or other processing or communication protocols issued by an external device (e.g., a server or mobile phone) to access the collected universal progressive data feed (step 608). In one embodiment, for example, the universal progressive data feed is published from one or more of the available gaming devices to a progressive value tracking system for implementation of additional protocols for processing, monitoring, and/or tracking each of the current progressive values that have been published. In an alternative embodiment, an external application may directly access the published universal data feed, and/or access the progressive value tracking system for obtaining the universal progressive data feed. The method 600 will display selected data from the published universal progressive data feed (step 610). The method 600 will display social media options for the user to upload selected data to the social media network (step 612). The method 600 will display the current progressive values for each one of the gaming devices according to a rank (e.g., from highest to lowest or lowest to highest) (step 614). The method 600 will then determine if the ranking of the current progressive values changed (step 616). If the ranking of the current progressive values has changed, the method 600 will display the reorganized current progressive values for each one of the gaming devices according to an updated rank (step 618). The method 600 may use a player tracking system in conjunction with the incorporated protocol for offering exclusive promotions and an exclusive membership (e.g., a group, organization, and/or players club and the like) (step 620). If the ranking of the current progressive values has not changed, the method 600 may go to step 620 and use a player tracking system with the incorporated protocol for offering exclusive promotions and an exclusive membership (step 620). The method 600 may display advertisements, a variety of exclusive and non-exclusive promotions, and exclusive membership (e.g., a group, organization, and/or players club and the like) information on the external application (step 622). The method 600 provides options and capabilities for online gaming to one or more of the gaming devices on the external application (step 624). For example, in one embodiment, a player may play an actual EGM that is using the invention described herein. The method 600 ends (step 626).

In at least one implementation, the filtered and/or customized information, which is displayed, on the mobile device may automatically and/or dynamically change based upon the identity and/or privileges (e.g., privileges for an exclusive members) of the current user who is operating the mobile device. For example, in one implementation, the mobile device may be adapted to store user profile information, which, for example, may include information relating to the various casinos, gaming devices, and the historical winnings. Additionally, the mobile device may be adapted to store customized, preconfigured filter parameters, which are linked to each respective user in the user profile database. Upon determining the identity of the current user operating either the gaming device and/or the mobile device, the customized, preconfigured filter parameters for the current user may be accessed and subsequently used during the information filter processing to generate appropriate filtered and/or customized information which is relevant to the current user, and customized by the vendor for displaying, for example the defined gaming venues, defined gaming device, advertisements, and exclusive and non-exclusive membership club promotions and other data.

In an alternate implementation, the filtered and/or customized information displayed on the mobile device may be acquired without necessarily requiring that the mobile device generate geolocation data relating to its current location. For example, in one embodiment, the mobile device may be adapted to communicate, via a wireless interface, only with defined gaming machines or other devices in a defined gaming venue for the progressive value tracking, which the mobile device believes are within a predetermined proximity to the mobile device. The mobile device may also be adapted to receive, via a wireless interface, information (e.g., the universal progressive data feed) from gaming machines or other devices on the casino floor, which are within a predefined range of the mobile device. For example, current implementations of Bluetooth™ technology allow a Bluetooth™ enabled device to communicate with other Bluetooth™ enabled devices, which are within a defined radius. Using such technology, the mobile device may be adapted to receive wireless information from gaming machines or other devices on the casino floor, which are within a predetermined proximity (e.g., within the casino location) of the mobile device. However, in at least one implementation, the mobile device will not receive wireless information from gaming machines or other devices on the casino floor, which are outside the predetermined and defined proximity.

It should be noted that each type and/or version of external devices (e.g., smart phones) may be fitted to each EGT. More specifically, the external devices may communicate and transmit data directly to an EGM (e.g., an IGT® EGM) without connecting to a device set up device from the gaming venue.

Figure 7:
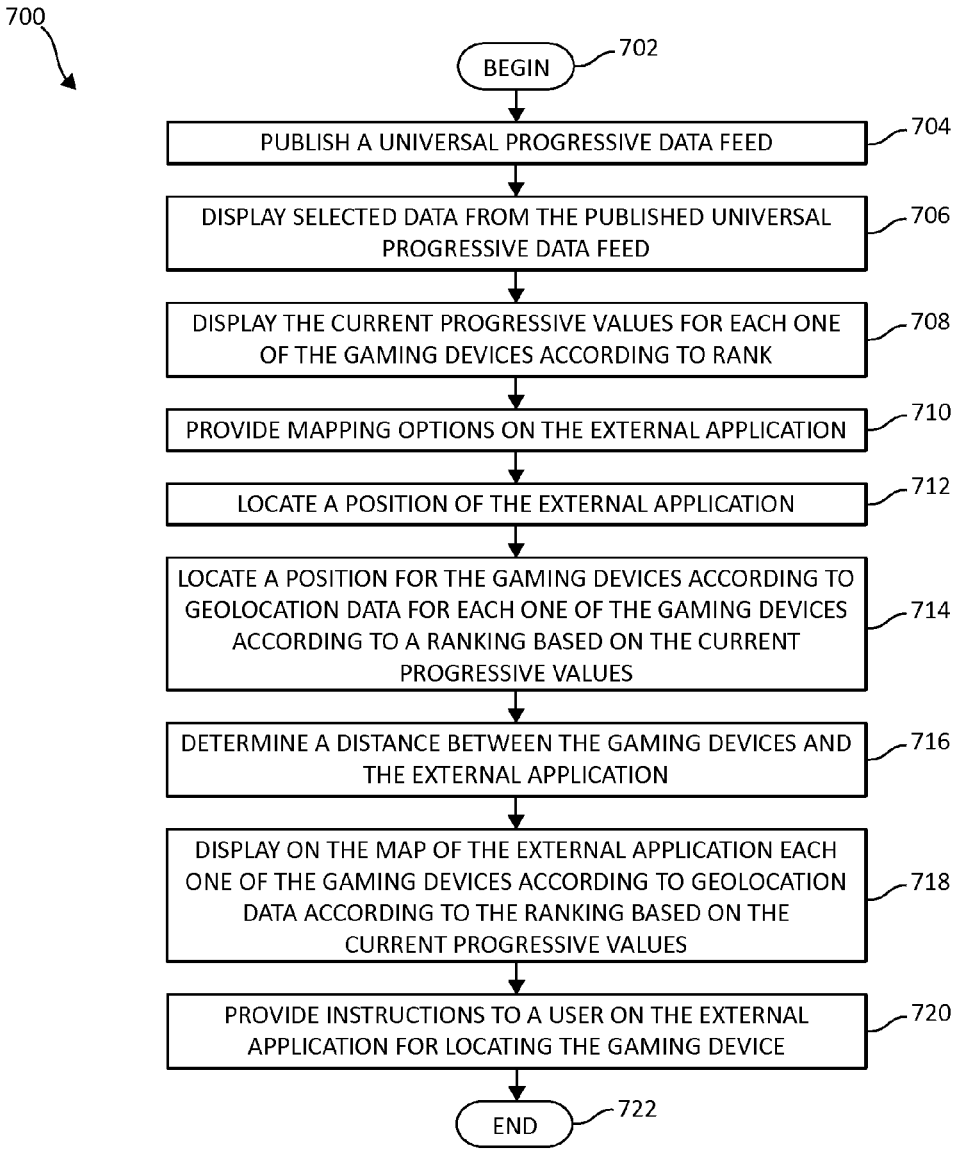
FIG. 7 is a flow chart illustrating an exemplary method for assisting a user to identify and locate a gaming device using an external device.

FIG. 7 is a flow chart illustrating an exemplary method 700 assisting a user to identify and locate one of the winning gaming devices on an external device. The method 700 begins (step 702) by publishing a universal progressive data feed to be accessible, for example, to an external application (step 704). The method 700 displays selected data from the published universal progressive data feed (step 706). The method 700 displays the current progressive values for each one of the gaming devices according to rank (step 708). The method 700 provides mapping options on the external application (step 710). For example, a third party-mapping feature is associated with and in communication with the external application for providing pin placement functionality, mapping and directions on the mobile device. Also, a map of a casino layout with access points, walkways, paths, and/or other entry points may also be uploaded and supplied to the application for providing the user with directions and instructions for locating and finding a gaming device. The method 700 locates a position of the external application (step 712). The method 700 locates a position for the gaming devices according to geolocation data for each one of the gaming devices according to a ranking based on the current progressive values (step 714). The method 700 determines a distance between the gaming devices and the external application (step 716). The method 700 displays on the map of the external application each one of the gaming devices according to geolocation data according to the ranking based on the current progressive values (step 718). The method 700 displays instructions (e.g., audio and/or visual) on the external application to a user for locating the gaming device (step 720). The method 700 ends (step 722).

Figure 8:
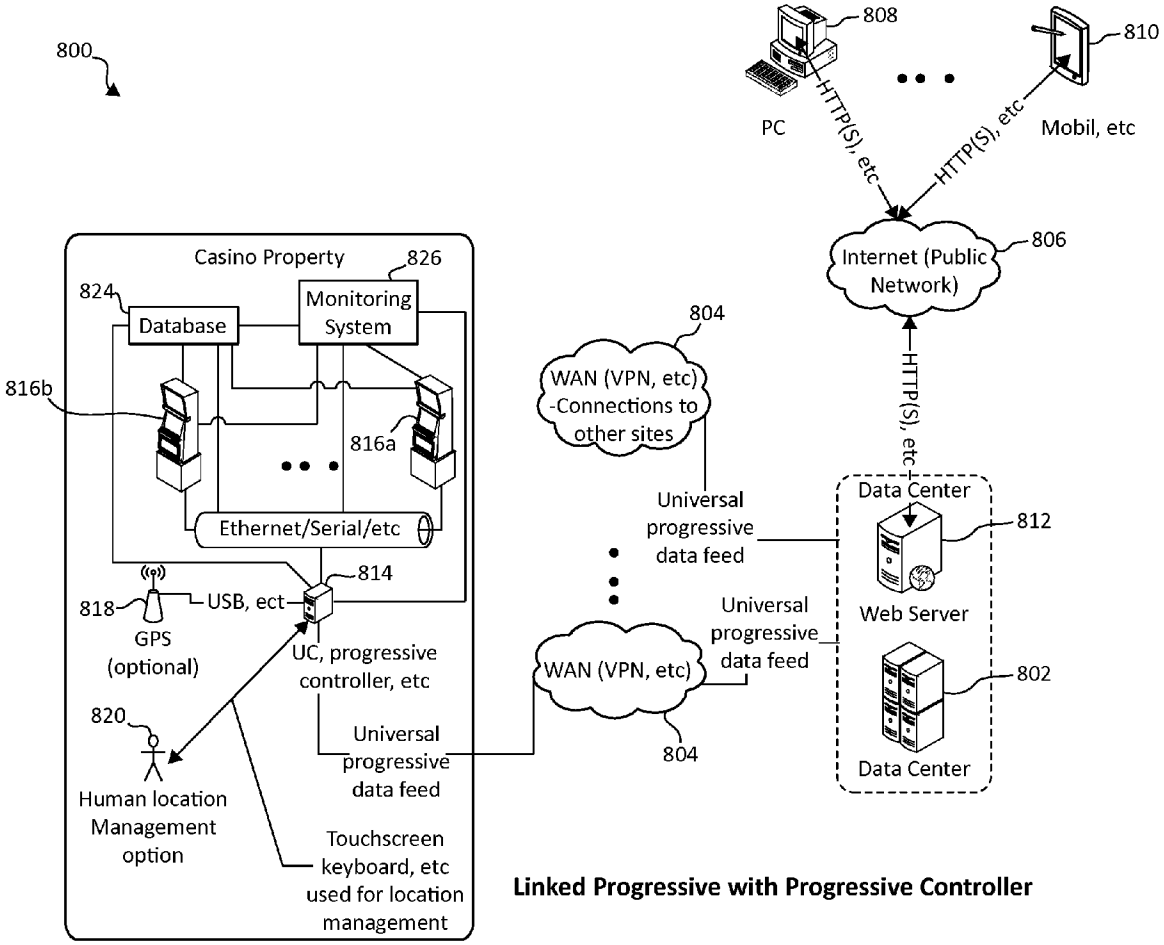
FIG. 8 is a block diagram illustrating a linked progressive gaming system with a progressive controller, in which aspects of the present invention may be realized.
Figure 9:
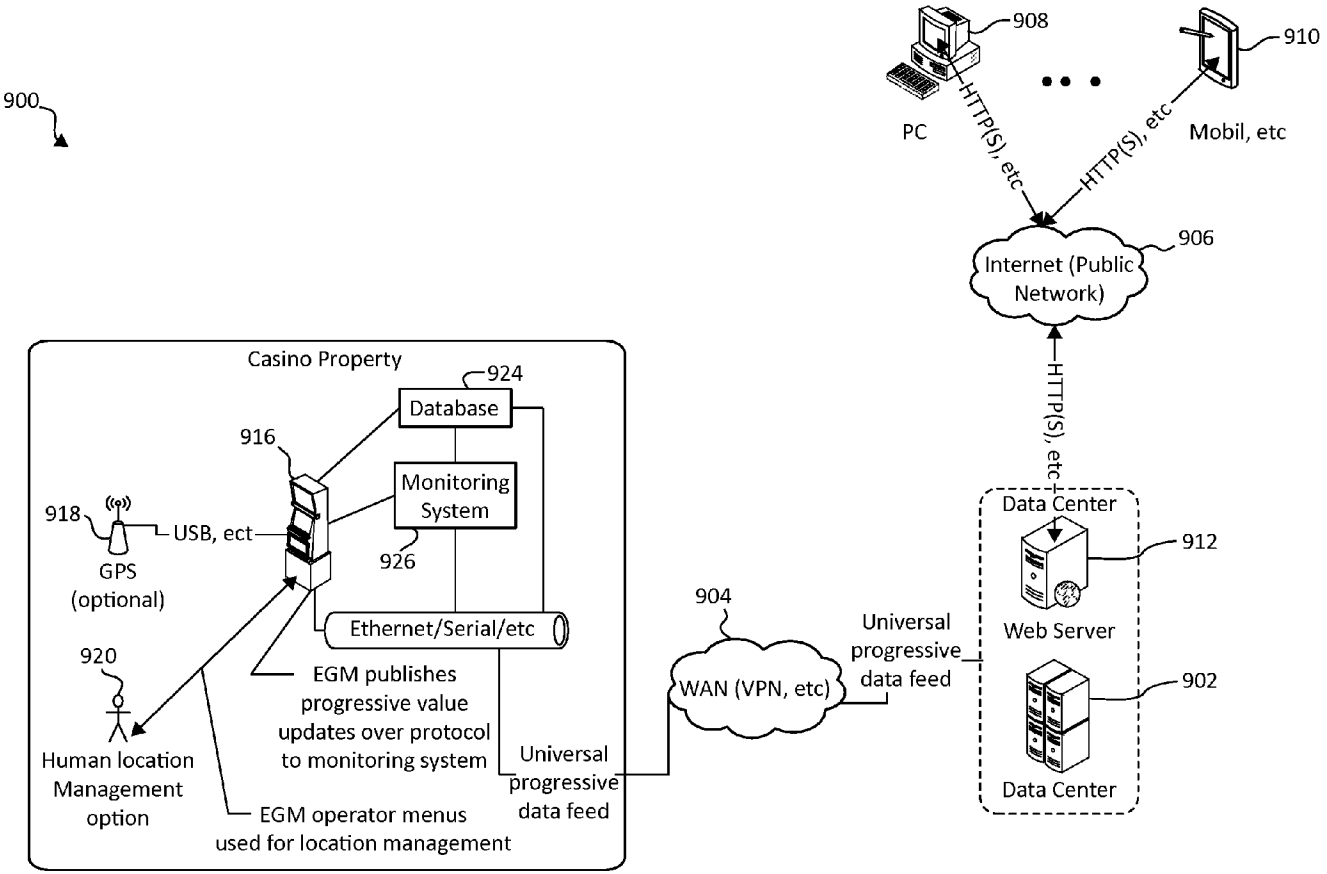
FIG. 9 is a block diagram illustrating a standalone progressive gaming system, in which aspects of the present invention may be realized.
Figure 10:
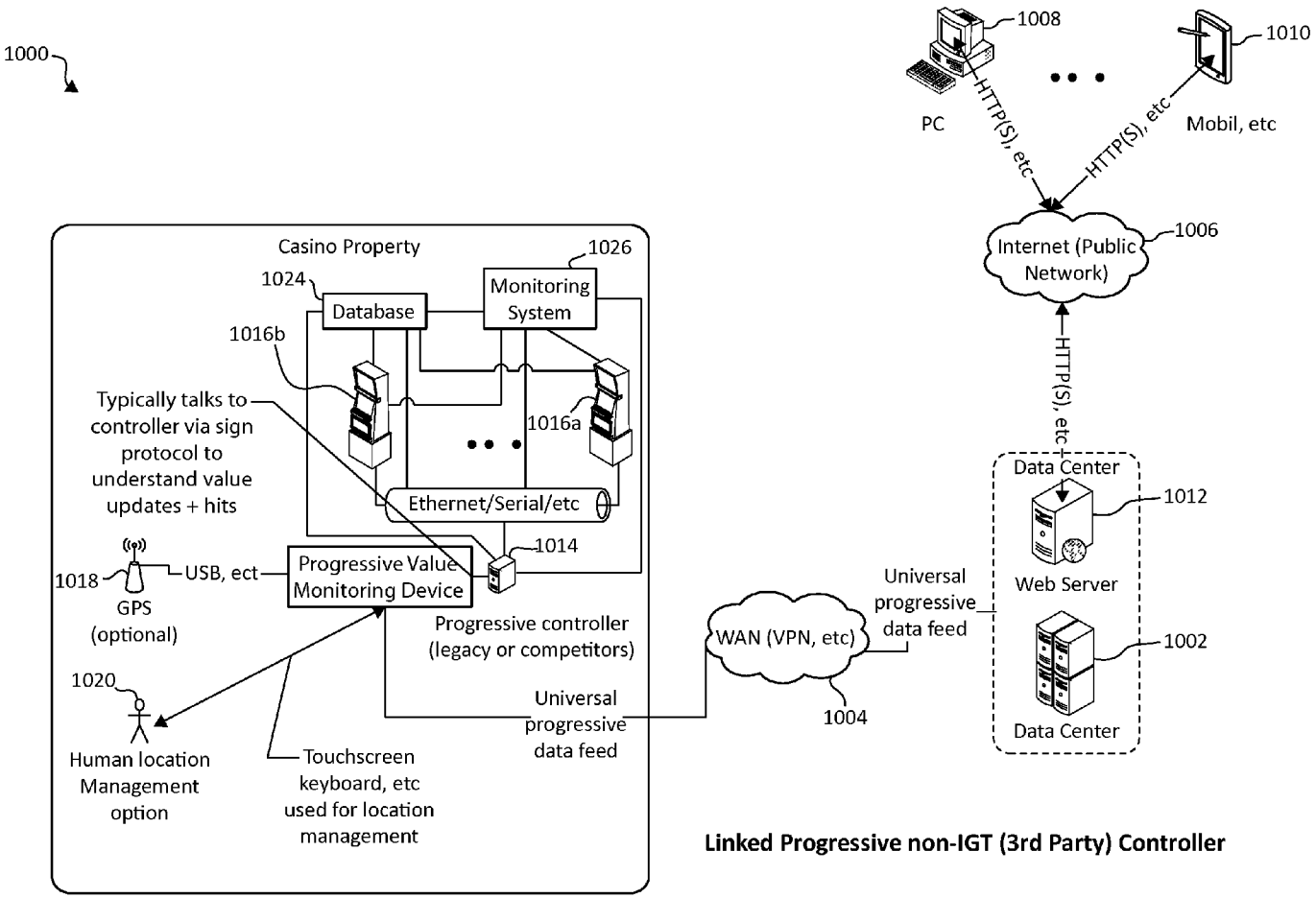
FIG. 10 is a block diagram illustrating a linked progressive gaming system having a third party controller, in which aspects of the present invention may be realized.

In order to support building applications (mobile or otherwise) for illustrating to the users of gaming devices the current progressive values and the respective location of those current progressive values, communication channels are created between a system that monitors and publishes the progressive values and the progressive controllers or Electronic Gaming Machines (EGMs) themselves. FIG. 8-10 illustrate a central progressive monitoring system that may obtain data from casino's/vendors (e.g., an IGT® progressive controller) and third party progressive controllers, as well as IGT® EGMs which natively support stand-alone progressive gaming systems.

FIG. 8 is a block diagram 800 illustrating a linked progressive gaming system with a progressive controller in which aspects of the present invention may be realized. In linked progressive gaming system with a progressive controller 814, the progressive controller 814 is a device (e.g., an IGT® manufactured device) that is changed to support a protocol, which publishes data to a progressive value tracking system. This protocol is called the "universal progressive data feed" protocol, and includes information such as progressive levels managed by the progressive controller 814, and/or levels managed by a single EGM 816 that are simply monitored by a controller (not shown).

In one embodiment, the progressive levels are not typically of a particular gaming device. For example, consider 5 progressive levels, with the max value of the individual levels described below:

Level 1: 10,000
Level 2: 3,000
Level 3: 700
Level 4: 200
Level 5: 50

If a controller is talking to 10 EGMs, each EGM will likely be contributing to all levels. So in a linked progressive model, the level isn't particular to one EGM. It's with respect to the controller, and each EGM is linked to the level. So if level 1 is at $7,000, then all EGMs see that level 1 is at $7,000. As such, as mentioned above, a protocol is called the "universal progressive data feed" protocol, and includes information such as progressive levels managed by the progressive controller 814, and/or levels managed by a single EGM 816 that are simply monitored by a controller (not shown).

The progressive controller 814 may also include a touch screen, keyboard, and other computing features providing for a human location management option 820. The progressive controller 814 monitors the game devices 816 that are connected to the game network 800. The progressive controller 814 also manages the progressive award by performing various accounting procedures (including but not limited to how much of each wager is incremented to the progressive and how much is placed in a reserve account for reseeding a progressive) regarding the amount wagered at each of the game devices 816 associated with the game network 800. The progressive controller 814 assigns a predetermined portion of the amounts wagered at each game device 816 to the progressive award amount. The progressive controller 814 also provides a series of menus displayed on a computer 808 and/or mobile device 810 for facilitating configuration of the various progressive awards that may be active on the game network 800. For example, in one embodiment the computer 808 may be replaced with other computing devices such as a mobile device 810 (e.g., a personal data assistant (PDA)).

In one embodiment, a gaming venue is shown with multiple gaming devices 816*a-b* that is connected in a networking environment to a progressive controller 814. Bi-directional communication channels 804 and 806 are provided for two-way communication between the progressive controller 814, a database 824, a monitoring system 826, a series of gaming devices 816, a web server 812, a data center 802, and the computer 808 and/or the mobile device 810. Communication between the components may be facilitated by an interface board (not shown). Thus, through the communication channels 804 and 806, the universal data feed is able to be harvested from the gaming device and displayed on the computer 808 and/or the mobile device 810. In one embodiment, the communication link 804 may be a wireless access network (WAN), a secure Ethernet type communication link, or USB connection, however, other types of secure communication links may be used such as, serial connections, dial-up or wireless connections. Alternatively, the connection 804 may occur via a network connection. In one embodiment, a public network (e.g., the internet) 806 may communicate between a web server 812 and data center 802 and the computer 808 and/or mobile device 810.

In one embodiment, a database 824 and a monitoring system 826 may be associated with the progressive controller 814 and the gaming devices 816. The monitoring system 826 may exclusively and/or in conjunction with the progressive controller 814, monitor and track any and all hits, level types, and progressive award values occurring during the gaming session for the gaming device(s) in a defined venue. The monitoring system 826 may also be used, in association with the progressive controller, for collecting and publishing the universal progressive data feed. In one embodiment, the monitoring system 826 may assist the progressive controller 814, through one or more protocols, to provide a current progressive level and a current level type to be interleaved with device characteristic information into the universal progressive data feed. The aforementioned characteristic information may include each of the progressive levels of the gaming device 816, the type of level(s) of the gaming device if applicable (e.g., wide-area progressive (WAP), non-WAP, etc.), geolocation information of each connected EGM, and/or the location of the progressive controller 814 itself. Such characteristic information may be collected from the progressive controller 814 and/or the monitoring system 826. In one embodiment, interleaving instructions may be received for interleaving selected characteristic data into the universal progressive data stream. For example, a first data chunk representing the geolocation of each electronic gaming machine (EGM) may be identified and interleaved/appended into the universal progressive data stream, while a second data chunk representing a current progressive level of one of the gaming devices 816 is subsequently interleaved into the universal progressive data stream. As one of ordinary skill in the art will appreciate, the construction of the universal progressive data stream may vary according to a particular application. For example, the universal progressive data stream may be embodied as/in and/or contain at least characteristics of a communications protocol, a network protocol, a data processing operation, a data storage operation such as a read and/or write instruction, and the like.

The monitoring device 826 may be configured to update all hits, level types, and progressive award values occurring during a particular gaming session in real-time. Thus, the universal progressive data feed may be dynamically updated for providing real-time access to live data of the gaming device during the gaming session. The characteristic information, including the geolocation information, may then be published to a database 824 for subsequent use, post processing, and retrieval and/or access. In one embodiment, by way of example only, the database is provided access by the web server 812, the data center 802, and the computer 808 and/or mobile device 810, thereby allowing an external application to access and display selective data from the universal progressive data feed relating to one or more of the gaming devices in a defined gaming venue.

In one embodiment, the progressive controller 814 may include a GPS system 818 for communicating to geolocation information to computer 808 and/or mobile device 810, including, for example, the location of one of the gaming devices 816 operated by a user, or even the location of progressive controller 814, if desired. The computer 808 and/or mobile device 810 may include a touch screen, keyboard and other computing features providing the user with the ability to receive a data gleaned from the universal progressive data feed via a wireless access network (WAN) 804 for communicating to other venue sites and/or the computer 808 and/or mobile device 810. The universal progressive feed may be sent from the progressive controller 814 through one of the variety of types of communication channels 804, (e.g., a virtual private network (VPN) that provides a communication network that tunnels through another specifically dedicated network) to either the web server 812 and/or the data center 802, where in turn the web server 812 provides the data gleaned from the universal progressive data feed via the internet 806 to the computer 808 and/or the mobile device 810.

Turning now to FIG. 9, a block diagram 900 illustrating a standalone progressive gaming system in which aspects of the present invention may be realized, is shown. A gaming venue is shown with a gaming device 916 that is connected in a networking environment to a progressive controller (not shown). In the standalone progressive gaming system with a progressive controller, the progressive controller is actually placed and secured inside the gaming device 916 (e.g., the EGM). The progressive controller may be a hardware device (e.g., an IGT® manufactured device) and/or may be a software component that runs on the EGM (e.g., an IGT® manufactured device) that is changed to support a protocol, which publishes data to a progressive value tracking system, for example. The entity that owns, operates, and/or manufactures the gaming device, publishes the progressive value updates, hits, and the EGM location information. Here again, the protocol is called the universal progressive data feed protocol, and may include, but is not expressly limited to, information such as the values of the progressive levels of the gaming device 916, the type of level(s) of the gaming device if applicable (e.g., wide-area progressive (WAP), non-WAP, etc.), a location of each connected EGM, and/or the location of the progressive controller itself The progressive controller, which may be a hardware device housed within each of the gaming devices 916 and/or may be a software component, monitors the game device 916 that is connected to the game network 900. The progressive controller also manages the progressive award by performing various accounting procedures (including but not limited to how much of each wager is incremented to the progressive and how much is placed in a reserve account for reseeding a progressive) regarding the amount wagered at each of the game devices 916 associated with the game network 900. The progressive controller assigns a predetermined portion of the amounts wagered at each game device 916 to the progressive award amount. The progressive controller also provides a series of menus displayed on a computer 908 and/or mobile device 910 for facilitating configuration of the various progressive awards that may be active on the game network 900. For example, in one embodiment the computer 908 may be replaced with other computing devices such as a mobile device 910 (e.g., a personal data assistant (PDA)).

Bi-directional communication channels 904 and 906 are provided for two-way communication between the progressive controller housed within each gaming device 916, a database 924, a monitoring system 926, one or more gaming devices 916 themselves, a web server 912, a data center 902, and the computer 908 and/or the mobile device 910. Communication between the components may be facilitated by an interface board (not shown). Thus, through the communication channels 904 and 906 the universal data feed are able to be harvested from the gaming device and displayed on the computer 908 and/or the mobile device 910. In one embodiment the communication link 904 may be a wireless access network (WAN), a secure Ethernet type communication link, or USB connection, however, other types of secure communication links may be used such as, serial connections, dial-up or wireless connections. Alternatively, the connection 904 may occur via a network connection. In one embodiment, a public network (e.g., the internet) 906 may communicate between a web server 912 and data center 902 and the computer 908 and/or mobile device 910.

In one embodiment, a database 924 and a monitoring system 926 may be associated with the progressive controller housed within the gaming devices 916. The monitoring system 926 may exclusively and/or in conjunction with the progressive controller, monitor and track any and all hits, level types, and progressive award values occurring during the gaming session for the gaming device(s) in a defined venue. In other word, FIG. 9 is illustrating a scenario where the EGM itself is natively communicating with the progressive data feed protocol rather than requiring an external device to speak with the progressive data feed protocol. As such, the monitoring system 926 may be associated with the progressive controller according to design preference. The monitoring system 926 may also be used, in association with the progressive controller in the gaming device 916, for collecting and publishing the universal progressive data feed. In one embodiment, the monitoring system 926 may assist the progressive controller, through one or more protocols, to provide a current progressive level and a current level type to be interleaved with device characteristic information into the universal progressive data feed. The aforementioned characteristic information may include each of the progressive levels of the gaming device 916, the type of level(s) of the gaming device if applicable (e.g., wide-area progressive (WAP), non-WAP, etc.), geolocation information of each connected EGM, and/or the location of the progressive controller itself. Such characteristic information may be collected from the progressive controller and/or the monitoring system 926. In one embodiment, interleaving instructions may be received for interleaving selected characteristic data into the universal progressive data stream. For example, a first data chunk representing the geolocation of each electronic gaming machine (EGM) may be identified and interleaved/appended into the universal progressive data stream, while a second data chunk representing a current progressive level of one of the gaming devices 916 is subsequently interleaved into the universal progressive data stream. As one of ordinary skill in the art will appreciate, the construction of the universal progressive data stream may vary according to a particular application. For example, the universal progressive data stream may be embodied as/in and/or contain at least characteristics of a communications protocol, a network protocol, a data processing operation, a data storage operation such as a read and/or write instruction, and the like.

The monitoring device 926 may be configured to update all hits, level types, and progressive award values occurring during a particular gaming session in real-time. The monitoring device 926 may work in conjunction and in association with a progressive controller housed within the gaming device 916 as needed for monitoring, updating, and tracking all hits, level types, and progressive award values. As mentioned above, FIG. 9 is illustrating a scenario where the EGM itself is natively communicating with the progressive data feed protocol rather than requiring an external device to speak with the progressive data feed protocol. As such, the monitoring system 926 may be associated with the progressive controller and/or removed according to design preference and technical capabilities of the gaming venue. Thus, the universal progressive data feed may be dynamically updated for providing real-time access to live data of the gaming device during the gaming session. The characteristic information, including the geolocation information, may then be published to a database 924 for subsequent use, post processing, and retrieval and/or access. In one embodiment, by way of example only, the database is provided access by the web server 912, the data center 902, and the computer 908 and/or mobile device 910, thereby allowing an external application to access and display selective data from the universal progressive data feed relating to one or more of the gaming devices in a defined gaming venue.

The gaming device 916 includes EGM operator menus used for location management 920. The progressive controller in the gaming device 916 may include and/or be associated with a GPS system 918 for broadcasting to a computer 908 and/or mobile device 910 the location of one of the gaming devices 916 operated by a user or even the progressive controller, if desired. The computer 908 and/or mobile device 910 may include a touch screen, keyboard and other computing features providing the user with the ability to receive a unique progressive data feed via a wireless access network (WAN) 904 for communicating to other venue sites and/or the computer 908 and/or mobile device 910. The universal progressive feed may be sent from the progressive controller through one of the variety of types of communication channels 904, such as a VPN, to either the web server 912 and/or the data center 902, where in turn the web server 913 provides data obtained from universal progressive feed via the internet 906 to the computer 908 and/or the mobile device 910.

FIG. 10 is a block diagram 1000 illustrating a linked progressive gaming system having a third party controller, in which aspects of the present invention may be realized. Similar to FIG. 8 with the linked progressive gaming system, in the linked progressive third party controller system, a group of EGMs 1016 (shown as 1016*a-b*) are communicating with the progressive controller 1014, which is managing one or more progressive prize pools, but the progressive controller 1014 is owned or managed by a third party provider. It should be noted that each component described throughout each figure described herein (e.g., FIG. 9) may include its own unique and individual processor and database. For example, the progressive value-monitoring device 926 may have its own individual processor and database. Progressive controller 1014 supports a standard progressive sign protocols. A secondary device (e.g., a monitoring system 1026) may be implemented which interfaces with the progressive controller 1014 to monitor progressive values and hits of the gaming devices 1016 using these standard sign protocols. Thus, in one embodiment, implementing the protocol, as described above in FIG. 4, step 406, includes implementing a modified sign protocol that accommodates the current progressive value and current geolocation data. The secondary device would also require a user interface (UI) such as a touch screen, keyboard and other computing features, for allowing an operator to program location information of connected machines and/or human location management 1020. In one embodiment, a gaming venue is shown with multiple gaming devices 1016*a-b* that is connected in a networking environment to a third party ($3^{rd}$ Party) progressive controller 1014.

The progressive controller 1014 monitors the game devices 1016 that are connected to the game network 1000. The progressive controller 1014 also manages the progressive award by performing various accounting procedures (including, but not limited to, how much of each wager is incremented to the progressive and how much is placed in a reserve account for reseeding a progressive) regarding the amount wagered at each of the game devices 1016 associated with the game network 1000. The progressive controller 1014 assigns a predetermined portion of the amounts wagered at each game device 1016 to the progressive award amount. The progressive controller 1014 also provides a series of menus displayed on a computer 1008 and/or mobile device 1010 for facilitating configuration of the various progressive awards that may be active on the game network 1000. For example, in one embodiment the computer 1008 may be replaced with other computing devices such as a mobile device 1010 (e.g., a personal data assistant (PDA)).

In one embodiment, a gaming venue is shown with multiple gaming devices 1016*a-b* that is connected in a networking environment to a progressive controller 1014. Bi-directional communication channels 1004 and 1006 are provided for two-way communication between the progressive controller 1014, a series of gaming devices 1016, a web server 1012, a data center 1002, and the computer 1008 and/or the mobile device 1010. Communication between the components may be facilitated by an interface board (not shown). Thus, through the communication channels 1004 and 1006 the universal data feed is able to be harvested from the gaming device and displayed on the computer 1008 and/or the mobile device 1010. In one embodiment the communication link 1004 may be a wireless access network (WAN), a secure Ethernet type communication link, or USB connection, however, other types of secure communication links may be used such as, serial connections, dial-up or wireless connections. Alternatively, the connection 1004 may occur via a network connection. In one embodiment, a public network (e.g., the internet) 1006 may communicate between a web server 1012 and data center 1002 and the computer 1008 and/or mobile device 1010.

In one embodiment, a database 1024 and a monitoring system 1026 may be associated with the progressive controller 1014 and the gaming devices 1016. As mentioned above, a secondary device (e.g., a monitoring system 1026) work in conjunction with the progressive controller 1014, and monitor, track, and update any and all hits, level types, and progressive award values occurring during the gaming session for the gaming device(s) in a defined venue. The monitoring system 1026 may assist in implementing and processing the modified sign protocol that accommodates the current progressive value and current geolocation data. The monitoring system 1026 may also be used, in association with the progressive controller, for collecting and publishing the universal progressive data feed. In one embodiment, the monitoring system 1026 may assist the progressive controller 1014, through one or more protocols, to provide a current progressive level and a current level type to be interleaved with device characteristic information into the universal progressive data feed. The aforementioned characteristic information may include each of the progressive levels of the gaming device 1016, the type of level(s) of the gaming device if applicable (e.g., wide-area progressive (WAP), non-WAP, etc.), geolocation information of each connected EGM, and/or the location of the progressive controller 1014 itself. Such characteristic information may be collected from the progressive controller 1014 and/or the monitoring system 826. In one embodiment, interleaving instructions may be received for interleaving selected characteristic data into the universal progressive data stream. For example, a first data chunk representing the geolocation of each electronic gaming machine (EGM) may be identified and interleaved/appended into the universal progressive data stream, while a second data chunk representing a current progressive level of one of the gaming devices 1016 is subsequently interleaved into the universal progressive data stream. As one of ordinary skill in the art will appreciate, the construction of the universal progressive data stream may vary according to a particular application. For example, the universal progressive data stream may be embodied as/in and/or contain at least characteristics of a communications protocol, a network protocol, a data processing operation, a data storage operation such as a read and/or write instruction, and the like.

The monitoring device 1026 may be configured to update all hits, level types, and progressive award values occurring during a particular gaming session in real-time. Thus, the universal progressive data feed may be dynamically updated for providing real-time access to live data of the gaming device during the gaming session. The characteristic information, including the geolocation information, may then be published to a database 1024 for subsequent use, post processing, and retrieval and/or access. In one embodiment, by way of example only, the database is provided access by the web server 1012, the data center 1002, and the computer 1008 and/or mobile device 1010, thereby allowing an external application to access and display selective data from the universal progressive data feed relating to one or more of the gaming devices in a defined gaming venue.

The 3$^{rd}$ Party progressive controller 1014 may include and or be in communication with a GPS system 1018 for broadcasting to a computer 1008 and/or mobile device 1010 the location of one of the gaming devices 1016 operated by a user or even the progressive controller 1014, if desired. The computer 1008 and/or mobile device 1010 may include a touch screen, keyboard and other computing features providing the user with the ability to receive a unique or tailored information gleaned from the progressive data feed via a wireless access network (WAN) 1004 for communicating to other venue sites and/or the computer 1008 and/or mobile device 1010. The universal progressive feed may be sent from the progressive controller 1014 through one of the variety of types of communication channels 1004, such as a VPN, to either the web server 1012 and/or the data center 1002, where in turn the web server 1013 provides the universal progressive feed via the internet 1006 to the computer 1008 and/or the mobile device 1010.

Figure 11B:
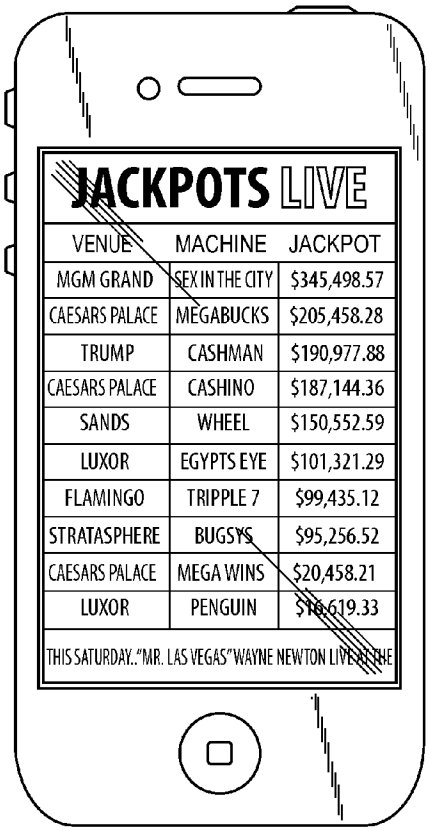
FIG. 11B illustrates an additional GUI screen showing a ranked order of winning gaming devices based on a current progressive value.
Figure 11A:
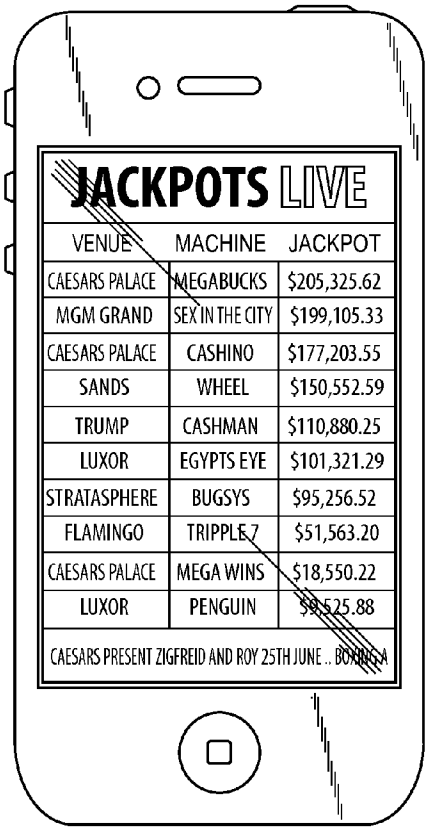
FIG. 11A illustrates an exemplary Graphical User Interface (GUI) screen on a mobile device showing a ranked order of winning gaming devices based on a current progressive value.

FIG. 11A-B is a diagram illustrating an exemplary mobile device displaying a ranked order of winning gaming devices based on a current progressive value in which aspects of the present invention may be realized. As illustrated in the FIG. 11*a*, the mobile devices provides for customizable display via an external application (e.g., a mobile phone application) of the universal data feed. In one embodiment, by way of example and illustration only, the external application is referred to as "JACKPOTS LIVE" (or maybe referred to as "JACKPOT FINDER GPS" or "JACKPOT HUNTER GPS) for showing a current progressive value/jackpot for those gaming devices within a predetermined venue. The jackpot is ranked from highest to lowest and lists the venue according to a predetermined area. The view for display shows the current progressive values of the ranked gaming devices based on an international, national, state, or venue specific region determined by a vendor (e.g., a casino). As seen in FIG. 11*a*, the following sample universal feed data is displayed:

| VENUE | MACHINE | JACKPOT |
|---|---|---|
| CAESARS PALACE | MEGABUCKS | $205,325.62 |
| MGM GRAND | SEX IN THE CITY | $199,105.33 |
| CAESARS PALACE | CASHINO | $177,203.55 |
| SANDS | WHEEL | $150,552.59 |
| TRUMP | CASHMAN | $110,880.25 |
| LUXOR | EGYPTS EYE | $101,321.29 |
| STRATASPHERE | BUGSYS | $ 95,256.52 |
| FLAMINGO | TRIPPLE 7 | $ 51,563.20 |
| CAESARS PALACE | MEGAWINS | $ 18,550.22 |
| LUXOR | PENGUIN | $ 9,525.88 |

However, because the current progressive value/jackpots may are dynamic and constantly being updated, changed, and revised, for those gaming devices within a predetermined venue, the ranking of the current progressive values are also reordered and updated at periodic interval as defined by a vendor or manufacturer. For example, depending on a vendor's preferences and/or ongoing promotions, the universal data feed may be updated in real time, every minute, and/or every hour from highest to lowest and lists the venue according to a predetermined area. As seen in FIG. 11*b*, the following sample universal feed data is displayed:

| VENUE | MACHINE | JACKPOT |
|---|---|---|
| MGM GRAND | SEX IN THE CITY | $345,498.57 |
| CAESARS PALACE | MEGABUCKS | $205,458.28 |
| TRUMP | CASH MAN | $190,977.88 |
| CAESARS PALACE | CASHINO | $187,144.36 |
| SANDS | WHEEL | $150,552.59 |
| LUXOR | EGYPTS EYE | $101,321.29 |
| FLAMINGO | TRIPPLE 7 | $ 99,435.12 |
| STRATASPHERE | BUGSYS | $ 95,256.52 |
| CAESARS PALACE | MEGAWINS | $ 20,458.21 |
| LUXOR | PENGUIN | $ 16,619.33 |

As illustrated in FIG. 11*b*, as the current progressive value/jackpots were monitored and tracked during a predetermined period of time, the current progressive values changed. Following the harvesting of the updated universal data feed, the updated universal data feed was republished, processed, and provided access for display to the external application with a newly reordered ranking of the current progressive values. Thus, in FIG. 11, the SEX IN THE CITY gaming device at the MGM grand paid out either a fixed award, a progressive award, and/or a combination of the fixed award with a new current progressive value being $345,498.57 as compared to $199,105.33 as shown in FIG. 11*a*. The SEX IN THE CITY gaming device at the MGM grand is now in a first place ranked position. The MEGABUCKS gaming device from the defined venue at Caesars Palace moved from the first place ranked order position to a second place ranked order position with an updated current progressive value of $205,458.28. Also, the CASHMAN gaming device at the Trump Casino moved up into a third place ranked position and now shows a current progressive value of $190,977.88, as compared to being in a fifth place ranked position having a current progress value in FIG. 11A of $110,880.25. The CASHINO at the Caesars Palace casino dropped from a third place ranked position with a current progressive value of $177,203.55 in FIG. 11A to a fourth place ranked position, despite showing an increase in the new current progressive value to a new value of $187,144.36 in FIG. 11B. The EGYPTS EYE gaming device at the Luxor casino remained the same with a current progressive value $101,321.29. The TRIPLE 7 gaming device at the Flamingo casino likewise paid out a large progressive jackpot, prize, and/or award and with a new current progressive value being $99,435.12 and was reordered one position (reordered to the seventh place ranked position) above the BUGSYS gaming device at the stratosphere venue, now in an eighth place ranked position with a current progressive value of $95,256.52. The MEGAWINS gaming device at Caesars Palace remained in a ninth place ranked position and during the monitoring period updated the current progressive value from $18,550.22 to $20,458.21. The PENGUIN gaming device at the Luxor Casino remained in a tenth place ranked position, and during the monitoring period updated the current progressive value from $9,525.88 to $16,619.33.

Also, a global positioning satellite (GPS) jackpot locator (e.g., a geolocation module) may be associated with the mobile device for providing directions and information (e.g., audio and visual directions, including but not limited to, pin mapping features, etc.). This allows a user able to quickly and efficiently identify, locate, and use, if available, the gaming device (e.g., the MGM GRAND casino which has a second to largest current progressive value). The present invention would then direct the user via GPS to the most exciting areas (e.g., the hot spot gaming devices) within a defined and participating venue(s). In this example, the hot spot gaming devices are the megabucks in the Caesars palace casino and the SEX IN THE CITY gaming device located in the MGM grand. In one embodiment, the current geolocation data of the gaming device is provided for processing (e.g., a protocol is used for accessing and processing the geolocation data in association with the universal data fee) using at least one of a Global Positioning System (GPS) device (e.g., the global positioning satellite (GPS) jackpot locator) associated with one of the hardware controllers and triangulation using radio signals in communication with one of the hardware controllers. The current progressive value and the current geolocation data may again, be continuously updated in real time.

In one embodiment, the geolocation module/GPS jackpot locator, for example, may be configured or designed to acquire geolocation information from remote sources and use the acquired geolocation information to determine information relating to a relative and/or absolute position of the mobile device and the gaming device displayed via the eternal application having a current progressive value displayed on the mobile device. For example, in one implementation, the GPS jackpot locator may be adapted to receive GPS signal information for use in determining the position or location of the mobile device. In another implementation, the geolocation module 546 may be adapted to receive multiple wireless signals from multiple remote devices (e.g., gaming machines, servers, wireless access points, etc.) and use the signal information to compute position/location information relating to the position or location of the mobile device and/or the gaming device. In one implementation, the mobile device and the gaming device are provided with wireless communication configurations/modules that may be configured or designed to communicate with external devices using one or more wireless interfaces/protocols such as, for example, Wi-Fi, Bluetooth™, WiMax, Cellular standards such as CDMA, CDMA2000, WCDMA, Radio Frequency (e.g., RFID), Infrared, and/or Near Field Magnetics, etc.

In one embodiment, the user or group of users are provided with various filtering capabilities for displaying the hot spot gaming devices. For example, the user would be able to view for display the current progressive values of the ranked gaming devices based on an international, national, state, or venue specific region. Also, the vendor that owns or operates the gaming device may also define and restrict the viewing capabilities of the current progressive values of the ranked gaming devices based on a international, national, state, or venue specific region or even by the gaming devices itself. For example, the vendor may only wish to provide the universal data feed for only certain types of gaming devices within a specified zone or range within only one casino.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that may contain, or store a program for use by or in connection with an instruction execution system, apparatus, or device.

Program code embodied on a computer readable medium may be transmitted using any appropriate medium, including but not limited to wireless, wired, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention have been described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that may direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the above figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, may be implemented by special purpose hardware-based systems that perform the specified functions or acts, or combinations of special purpose hardware and computer instructions.

What is claimed is:

1. A method for processing data in a gaming system having at least one processor device, the method comprising:

receiving a wage from a wage acceptor from at least one of a plurality of gaming devices for funding progressive awards;

collecting a current progressive value by a progressive controller from at least one of an available plurality of gaming devices funding the progressive awards in communication with the progressive controller;

acquiring and managing information from the at least one of an available plurality of gaming devices via a virtual information host in communication with the progressive controller for graphically displaying in real time the current progressive value;

processing the universal progressive data feed by a monitoring system in association with the progressive controller;

implementing a protocol by the progressive controller incorporating the current progressive value with current geolocation data associated with the one of the available plurality of gaming devices as a universal progressive data feed;

dynamically updating the current progressive value by the monitoring device from each one of the available plurality of gaming devices for providing real-time access to data on each one of the available plurality of gaming devices during a gaming session; and publishing to an external application by the progressive controller and the monitoring system a display of a ranked order of winning gaming devices based on the universal progressive data feed and a map of the at least one of an available plurality of gaming devices according to the current geolocation data according to the ranked order of the winning gaming devices based on the current progressive values, wherein the universal progressive data feed is updated in real time.

2. The method of claim 1, further including calculating the current progressive value for the one of the available plurality of gaming devices, wherein the current progressive value is representative of one of a fixed award, a progressive award, and a combination of the fixed award and the progressive award.

3. The method of claim 1, further including publishing the universal progressive data feed from the one of the available plurality of gaming devices, and at least one additional one of the available plurality of gaming devices to a progressive value tracking system.

4. The method of claim 3, further including incorporating, through the protocol, at least one of a current progressive level and a current level type into the universal progressive data feed.

5. The method of claim 1, wherein implementing the protocol further includes implementing a modified sign protocol that accommodates the current progressive value and current geolocation data.

6. The method of claim 1, further including providing the current geolocation data to the protocol using at least one of a Global Positioning System (GPS) device associated with the at least one processor device and triangulation using radio signals in communication with the at least one processor device, wherein the current progressive value and the current geolocation data are continuously updated in real time.

7. The method of claim 1, further including defining a gaming venue, including defining a number of the available plurality of gaming devices from which the universal progressive data feed is collected by a monitoring system.

8. The method of claim 7, further including defining an alternative gaming venue, including defining an additional number of the available plurality of gaming devices from which the universal progressive data feed is collected by the monitoring system.

9. The method of claim 1, further including collecting the universal progressive data feed in a monitoring system remotely geolocated.

10. The method of claim 9, further including processing and republishing the universal progressive data feed by the monitoring system in a database.

11. The method of claim 10, further including allowing access to the database by an external application.

12. The method of claim 11, further including executing the external application to display selected data from the database to a user of the available plurality of gaming devices.

13. The method of claim 12, wherein executing the external application further includes restricting at least a portion of the selected data from display to the user.

14. The method of claim 1, further including performing at least one of:

using a player tracking system in combination with the implemented protocol for creating an exclusive membership to a user, and offering an exclusive promotion to the user through the exclusive membership.

15. A system for processing data in a gaming environment having an available plurality of gaming devices, the system comprising:

a progressive controller;

a virtual information host in communication with the progressive controller;

a monitoring device in association with the progressive controller and the virtual information host;

the plurality of gaming devices in communication with the progressive controller and the monitoring device via a network;

at least one processor device operable on one of the available plurality of gaming devices each having a wage acceptor and in communication with the progressive controller and the monitoring device, wherein the at least one processor device:

receive a wage from a wage acceptor from at least one of a plurality of gaming devices for funding progressive awards;

collects a current progressive value by a progressive controller from at least one of an available plurality of gaming devices funding the progressive awards in communication with the progressive controller, acquires and manages information of the plurality of gaming devices via the virtual information host for graphically displaying in real time the current progressive value;

implements a protocol by the progressive controller incorporating the current progressive value with current geolocation data associated with the one of the available plurality of gaming devices as a universal progressive data feed, dynamically updates the current progressive value by the monitoring device from each one of the available plurality of gaming devices for providing real-time access to data on each one of the available plurality of gaming devices during a gaming session; and publishes to an external application by the progressive controller and the monitoring system a display of a ranked order of winning gaming devices based on the universal progressive data feed and a map of the at least one of an available plurality of gaming devices according to the current geolocation data according to the ranked order of the winning gaming devices based on the current progressive values, wherein the universal progressive data feed is updated in real time.

16. The system of claim 15, wherein the at least one processor device calculates the current progressive value for the one of the available plurality of gaming devices, wherein the current progressive value is representative of one of a fixed award, a progressive award, and a combination of the fixed award and the progressive award.

17. The system of claim 15, wherein the at least one processor device publishes the universal progressive data feed from the one of the available plurality of gaming devices, and at least one additional one of the available plurality of gaming devices to a progressive value tracking system.

18. The system of claim 17, wherein the at least one processor device incorporates, through the protocol, at least one of a current progressive level and a current level type into the universal progressive data feed.

19. The system of claim 15, wherein the at least one processor device implements a modified sign protocol that accommodates the current progressive value and current geolocation data.

20. The system of claim 15, further including at least one of Global Positioning System device and a radio transceiver in communication with the at least one processor device, wherein the at least one processor device provides the current geolocation data to the protocol using at least one of the GPS device, and triangulation using radio signals implemented by the radio transceiver, wherein the current progressive value and the current geolocation data are updated in real time.

21. The system of claim 15, wherein the at least one processor device defines a gaming venue, including defining a number of the available plurality of gaming devices from which the universal progressive data feed is collected by a monitoring system.

22. The system of claim 21, wherein the at least one processor device defines an alternative gaming venue, including defining an additional number of the available plurality of gaming devices from which the universal progressive data feed is collected by the monitoring system.

23. The system of claim 15, further including a monitoring system remotely geolocated, wherein the at least one processor device collects the universal progressive data feed in the monitoring system.

24. The system of claim 23, further including a database operational on the monitoring system.

25. The system of claim 24, further including an external application in communication with the database, wherein the external application is allowed access to the database.

26. The system of claim 25, wherein the external application is executed to display selected data from the database to a user of the available plurality of gaming devices.

27. The system of claim 26, wherein the external application restricts at least a portion of the selected data from display to the user.

28. The gaming system of claim 26, further including a player tracking system in communication with the at least one processor device, wherein the player tracking system:

creates an exclusive membership using the collected current progressive value, and offers an exclusive promotion to the exclusive membership.

29. A computer program product for processing data in a gaming environment having an available plurality of gaming devices with at least one processor device, the computer program product comprising a computer-readable storage medium having computer-readable program code portions stored therein, the computer-readable program code portions comprising:

a first executable portion that receives a wage from a wage acceptor from at least one of a plurality of gaming devices for funding progressive awards and collects a current progressive value by a progressive controller from at least one of an available plurality of gaming devices funding the progressive awards in communication with the progressive controller;

a second executable portion that processing the universal progressive data feed by the monitoring system in association with the progressive controller in a database and implements by the progressive controller a protocol incorporating the current progressive value with current geolocation data associated with the one of the available plurality of gaming devices as a universal progressive data feed; and a third executable portion that dynamically updates the current progressive value by the monitoring device from each one of the available plurality of gaming devices for providing real-time access to data on each one of the available plurality of gaming devices during a gaming session and publishes to an external application by the progressive controller and the monitoring system a display of a ranked order of winning gaming devices based on the universal progressive data feed and a map of the at least one of an available plurality of gaming devices according to the current geolocation data according to the ranked order of the winning gaming devices based on the current progressive values, wherein the universal progressive data feed is updated in real time.

30. The computer program product of claim 29, further including a fourth executable portion that calculates the current progressive value for the one of the available plurality of gaming devices, wherein the current progressive value is representative of one of a fixed award, a progressive award, and a combination of the fixed award and the progressive award.

31. The computer program product of claim 30, further including a fourth executable portion that publishes the universal progressive data feed from the one of the available plurality of gaming devices, and at least one additional one of the available plurality of gaming devices to a progressive value tracking system.

32. The computer program product of claim 31, further including a fifth executable portion that incorporates, through the protocol, at least one of a current progressive level and a current level type into the universal progressive data feed.

33. The computer program product of claim 29, further including a fourth executable portion that implements a modified sign protocol that accommodates the current progressive value and current geolocation data.

34. The computer program product of claim 29, further including a fourth executable portion that provides the current geolocation data to the protocol using at least one of a Global Positioning System (GPS) device associated with the at least one processor device and triangulation using radio signals in communication with at least one processor device, wherein the current progressive value and the current geolocation data are continuously updated in real time.

35. The computer program product of claim 29, further including a fourth executable portion that defines a gaming venue, including defining a number of the available plurality of gaming devices from which the universal progressive data feed is collected by a monitoring system.

36. The computer program product of claim 35, further including a fifth executable portion that defines an alternative gaming venue, including defining an additional number of the available plurality of gaming devices from which the universal progressive data feed is collected by the monitoring system.

37. The computer program product of claim 29, further including a fourth executable portion that:

collects the universal progressive data feed in a monitoring system remotely geolocated, and process the universal progressive data feed by the monitoring system in a database.

38. The computer program product of claim 29, further including a fourth executable portion that performs one of:

allowing access to the database by an external application, and executes the external application to display selected data from the database to a user of the available plurality of gaming devices.

39. The computer program product of claim 38, further including a fifth executable portion that restricts at least a portion of the selected data from display to the user.

40. The computer program product of claim 29, further including a fourth executable portion that performs at least one of:

using a player tracking system in combination with the implemented protocol for creating an exclusive membership to a user, and offering an exclusive promotion to the user through the exclusive membership.

* * * * *